US005883645A

United States Patent [19]

Ikado et al.

[11] Patent Number: 5,883,645

[45] Date of Patent: Mar. 16, 1999

[54] RECOVERY MECHANISM AND AN INK JET RECORDING APPARATUS USING THE RECOVERY MECHANISM

[75] Inventors: Masaharu Ikado; Makoto Kashimura; Hirofumi Hirano, all of Yokohama, Japan

[73] Assignee: Canon Kabushiki Kaisha, Tokyo, Japan

[21] Appl. No.: 969,359

[22] Filed: Oct. 30, 1992

[30] Foreign Application Priority Data

| | | | |
|---|---|---|---|
| Oct. 31, 1991 | [JP] | Japan | 3-311425 |
| Nov. 15, 1991 | [JP] | Japan | 3-300322 |
| Dec. 25, 1991 | [JP] | Japan | 3-357168 |

[51] Int. Cl.[6] ..... B41T 2/165; B41T 23/00

[52] U.S. Cl. ..... 347/30; 347/37

[58] Field of Search ..... 346/140 R; 347/22, 347/29, 32, 30, 37; 417/223, 242

[56] References Cited

U.S. PATENT DOCUMENTS

| | | | |
|---|---|---|---|
| 4,045,802 | 8/1977 | Fukazawa et al. | 347/29 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,510,510 | 4/1985 | Terasawa | 347/30 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,926,196 | 5/1990 | Mizoguchi et al. | 347/30 X |
| 5,024,587 | 6/1991 | Maurer | 417/488 |
| 5,138,343 | 8/1992 | Aichi et al. | 347/30 |
| 5,153,613 | 10/1992 | Yamaguchi et al. | 347/30 |
| 5,164,748 | 11/1992 | Katayanagi et al. | 347/30 |
| 5,166,708 | 11/1992 | Airano et al. | 347/30 X |

FOREIGN PATENT DOCUMENTS

| | | | |
|---|---|---|---|
| 0375407 | 6/1990 | European Pat. Off. | B41T 2/165 |
| 0422794 | 4/1991 | European Pat. Off. . | |
| 0423475 | 4/1991 | European Pat. Off. . | |
| 0449324 | 10/1991 | European Pat. Off. . | |
| 0451846 | 10/1991 | European Pat. Off. . | |
| 0482356 | 4/1992 | European Pat. Off. . | |
| 0505143 | 9/1992 | European Pat. Off. . | |
| 3900697 | 7/1990 | Germany . | |
| 59-123670 | 7/1984 | Japan . | |
| 59-138461 | 8/1984 | Japan . | |
| 60-174682 | 9/1985 | Japan . | |
| 61-237649 | 10/1986 | Japan . | |
| 4185353 | 7/1992 | Japan . | |

OTHER PUBLICATIONS

Grafstein, Paul and Schwara, Otto B., "Pictorial Handbook of Technical Devices", Chmical Publishing Co., Inc., New York, pp. 10–11, 1971.

*Primary Examiner*—David F. Yockey

*Attorney, Agent, or Firm*—Fitzpatrick, Cella, Harper & Scinto

[57] ABSTRACT

Ink jet recording apparatus including a carriage having a mounting portion for an ink jet recording head for performing recording on a recording medium by ejecting ink from the ink discharging ports to allow the ink jet recording head to travel in given directions, and a recovery mechanism for preventing disabled ejection of the ink jet recording head, which is provided with a driving force transmission mechanism capable of performing positional displacement to a first position for transmitting a driving force from a driving power source to the carriage and to a second position for transmitting the driving force from the driving power source to the recovery mechanism. The recovery mechanism includes a pump mechanism having a piston shaft within a cylinder with a pistion and a sealing member slidably fitted on the piston, where the cylinder, pistion and sealing member define a space for generating a pressure change in a cap.

30 Claims, 15 Drawing Sheets

RECOVERY MECHANISM AND AN INK JET RECORDING APPARATUS USING THE RECOVERY MECHANISM

BACKGROUND OF THE INVENTION

1. Field of the Invention

The present invention relates to an ink jet recording apparatus for performing recording by ejecting ink from the discharging ports to cause the ink to adhere to a recording material. More particularly, the invention relates to an ink jet recording apparatus provided with a recovery system including ink suction means to enable the recording head to maintain its stabilized ink ejection function, and such a recovery mechanism.

2. Related Background Art

Ink jet recording apparatuses are often provided with recovery means for recovering the ink ejection function of the recording head by removing the ink with increased viscosity and dust particles which adhere to the discharging ports of the recording head.

A recovery means of the kind comprises a cap to prevent ink from being dried in the discharging ports of a recording head; a pump unit to suck ink; and a wiping unit to wipe off the ink with increased viscosity, dust particles, and the like which adhere to the surface of the ink discharging ports. The driving force for those elements is transmitted from a carrier motor which drives a carriage.

In other words, for the ink jet recording apparatus, such a recovery means is not necessarily driven while the apparatus is engaged in its usual recording operation. Therefore, a clutch gear which engages with the pinion of the carrier motor is provided and then the clutch gear is shifted only when necessary to transmit the driving force to the recovery means therethrough. Thus, the number of motors is reduced.

Also, for the pump unit, a plunger type pump is mainly employed. A pump unit of the kind is of such a structure that only the piston which serves as a sealing member is reciprocated in the cylinder thereby to suck ink into the cylinder from the recording head with the negative pressure generated in the advancing stroke of the piston and exhaust the ink in the cylinder to an exhaust system in the returning stroke thereof.

In this type of conventional ink jet recording apparatus, it is necessary to provide a gear system including a clutch gear with a shaft, fixing wall, and other related components to support the gear system for the transmission of the driving force to its recovery means, which presents one of the hindrances to the miniaturization of the apparatus and the reduction of the manufacturing cost.

Also, with an additional arrangement of the gear, there are disadvantages in the aspects of the transmission efficiency and noises.

Also, in this type of conventional pump unit, there is a possibility that the ink which is supposed to be exhausted outside the cylinder by the returning stroke of the piston cannot withstand the liquid passage resistance in the exhaust system, and then the ink tends to be reversely forced into the recording head side from the ink suction inlet of the cylinder. Thus, if this reverse current phenomenon takes place, grease in the cylinder is carried to the discharging ports of the recording head to be mixed with ink before being ejected. There is a risk to create drawbacks such as an extreme degradation of the recording quality and the leakage of ink from the cap covering the recording head. Conventionally, therefore, a method is employed to provide a one-way valve for the ink passage in order to prevent the above-mentioned back flow of ink. However, with this method, there is a drawback that not only the cost is increased, but also the valving function of the one-way valve is hindered when ink is firmly fixed thereto. This cannot be an effective countermeasure.

Also, in a conventional cap of the kind, scratches tend to occur on the sealing surface when it is produced and also the defective caps can easily deformed due to insufficient filling of material. To increase its yield, therefore, the thickness of the sealing portion should be made thicker. Then, a problem is encountered that the deformation of the sealing surface is inhibited and then its sealing capability is lowered. Also, the silicone rubber which has an excellent ability to restore from compression over a wide temperature range can be formed by means of ejection molding. However, its gas transmissivity is so high that ink is easily evaporated when it is used as a cap. Thus, a problem is encountered that its anticipated effect to prevent ink from becoming too viscous is lowered.

SUMMARY OF THE INVENTION

With a view to solving the above-mentioned problems, the present invention is designed. It is an object of the invention to provide an ink jet recording apparatus having a recovery mechanism which enables the ink jet recording head to maintain its stabilized function of ink ejection.

It is another object of the present invention to provide an ink jet recording apparatus capable of driving the recovery mechanism with a simple driving mechanism.

It is still another object of the present invention to provide an ink jet recording apparatus having a recovery mechanism with a highly reliable low-cost pump unit capable of preventing the back flow of ink without using any one-way valves.

It is a further object of the present invention to provide an ink jet recording apparatus having a recovery mechanism with a desirably durable cap with a highly reliable sealing capability when the recording head is to be recovered by means of capping.

It is still a further object of the present invention to provide an ink jet recording apparatus which can be fabricated compactly at a low cost by arranging its structure such that when a carriage is shifted to a position where recovery means is provided, a driving force transmission member is shifted to a position enabling it to transmit its driving force to the recovery means so as to function as a clutch without any clutch gear which is conventionally required.

It is another object of the present invention to provide a highly reliable ink jet recording apparatus which can be fabricated at a low cost by arranging in a cylinder of the pump unit aside from its piston, a sealing member (piston seal) capable of being reciprocated and enabling the ink suction inlet of the cylinder to be shut so as to close the ink suction inlet with this sealing member for the prevention of the back flow of ink; thus making it possible to dispense with the check valve.

It is another object of the present invention to provide an ink jet recording apparatus capable of effectively preventing ink evaporation and leakage as well as avoiding any possibility that harmful components contained in the ink are not dissolved and ejected out in such a manner that an annular sealing member is formed separately with a resilient material and mounted in the seal portion of the capping member so as to make it possible to form the sealing member and the capping member independently with materials suited for the respective functions.

It is another object of the present invention to provide an ink jet recording apparatus having a mounting portion for mounting an ink jet recording head to perform recording on a recording medium by ejecting ink from ink discharging ports, which includes a carriage to allow the foregoing ink jet recording head to travel in a given direction, and a recovery mechanism provided with a driving force transmission mechanism capable of shifting its position to a first position where the driving force from a driving power is transmitted to the foregoing carriage and to a second portion where the driving force from the driving power source is transmitted to the foregoing recovery mechanism.

It is another object of the present invention to provide an ink jet recording apparatus including a mounting portion for mounting an ink jet recording head to perform recording on a recording medium by ejecting ink from ink discharging ports, and a recovery mechanism provided with a pump mechanism having a reciprocating piston in a cylinder as well as a reciprocating sealing member to close the ink suction inlet of the foregoing cylinder in order to prevent any disabled performance of ejection by the foregoing ink jet recording head.

It is still another object of the present invention to provide an ink jet recording apparatus including a mounting portion for mounting an ink jet recording head to perform recording on a recording medium by ejecting ink from ink discharging ports, and a capping member to prevent ink evaporation of and disabled ink ejection from the foregoing ink jet recording head with the installation of a sealing member made of a resilient material in the sealing portion of the foregoing capping member.

DETAILED DESCRIPTION OF THE PREFERRED EMBODIMENTS

Figure 1:
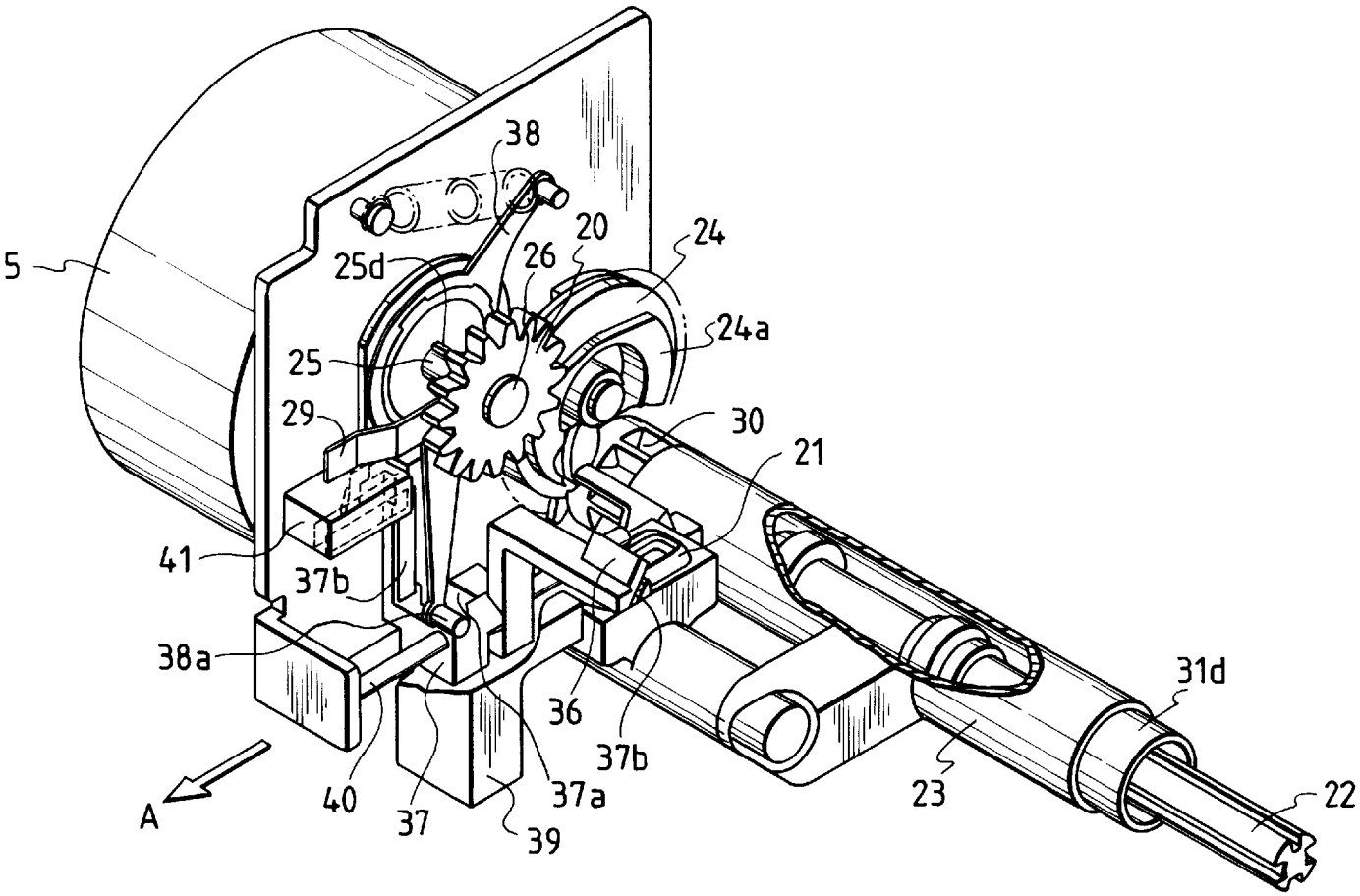
FIG. 1 is a detailed view showing an embodiment of a recovery mechanism according to the present invention.
Figure 2:
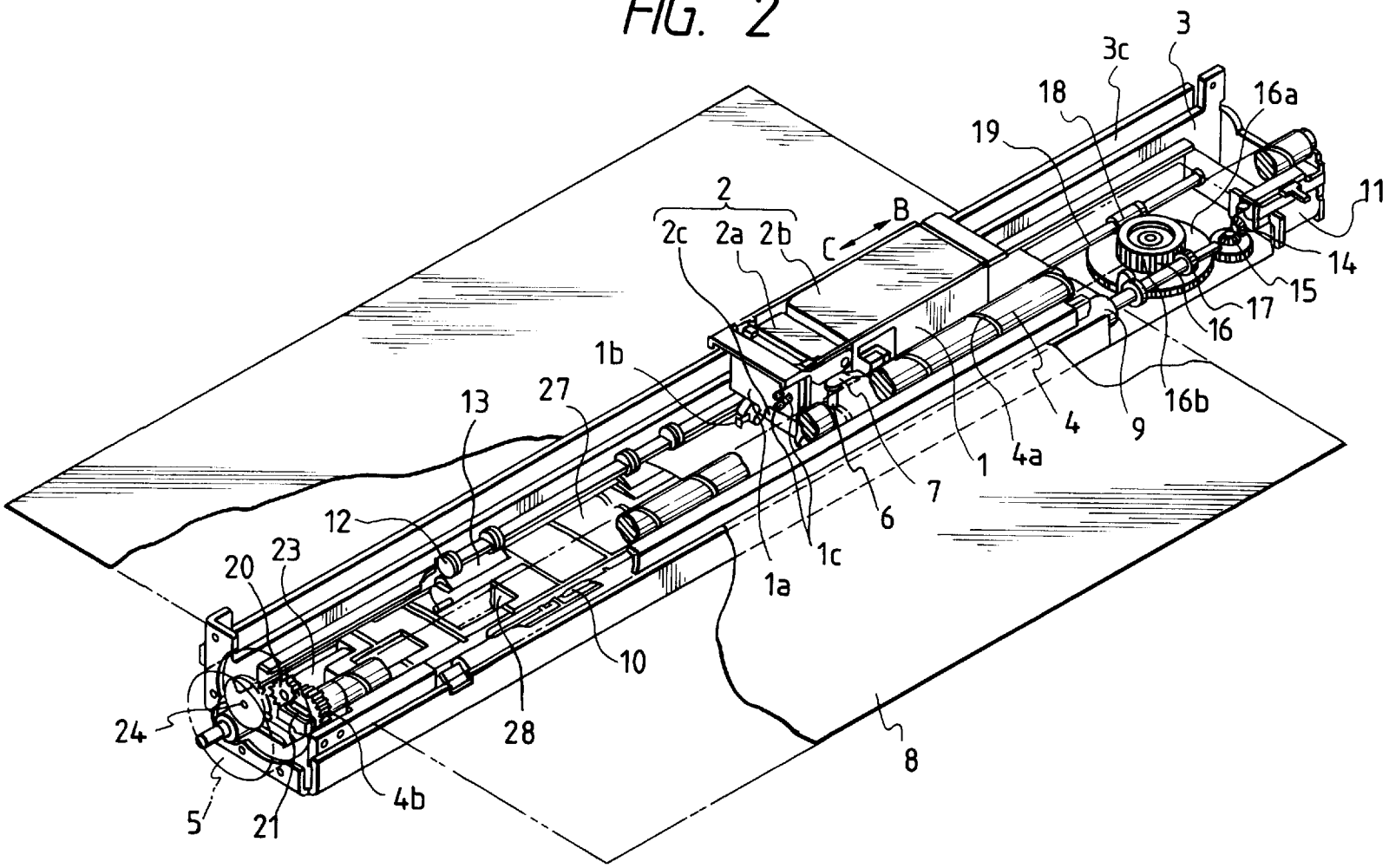
FIG. 2 is a view illustrating the entire body of an ink jet recording apparatus.
Figure 3:
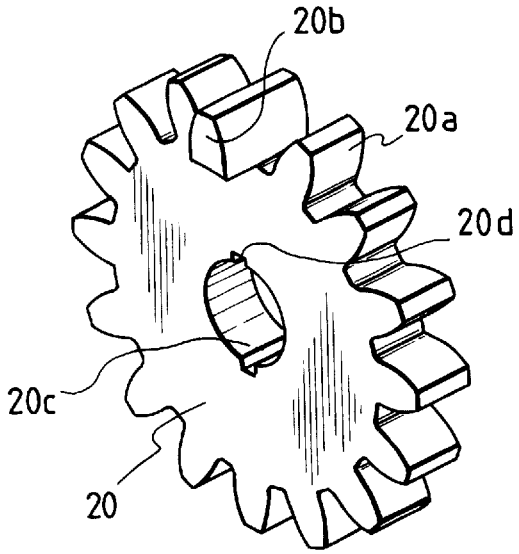
FIG. 3 is an enlargd view showing a carrier motor pinion.
Figure 4:
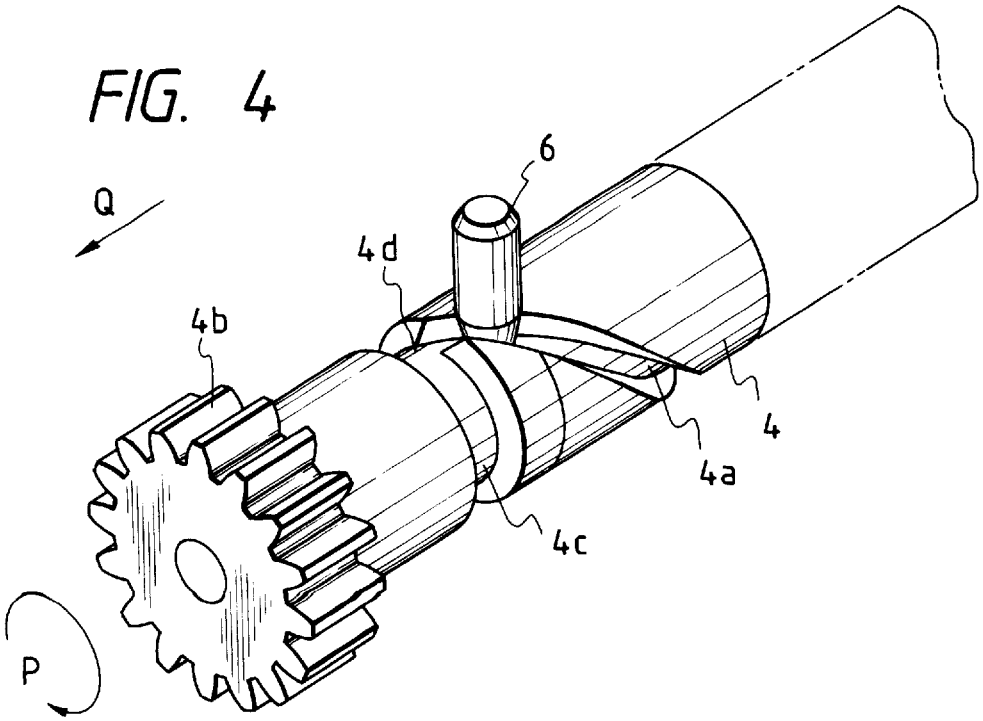
FIG. 4 is a view illustrating a lead groove.
Figure 5:
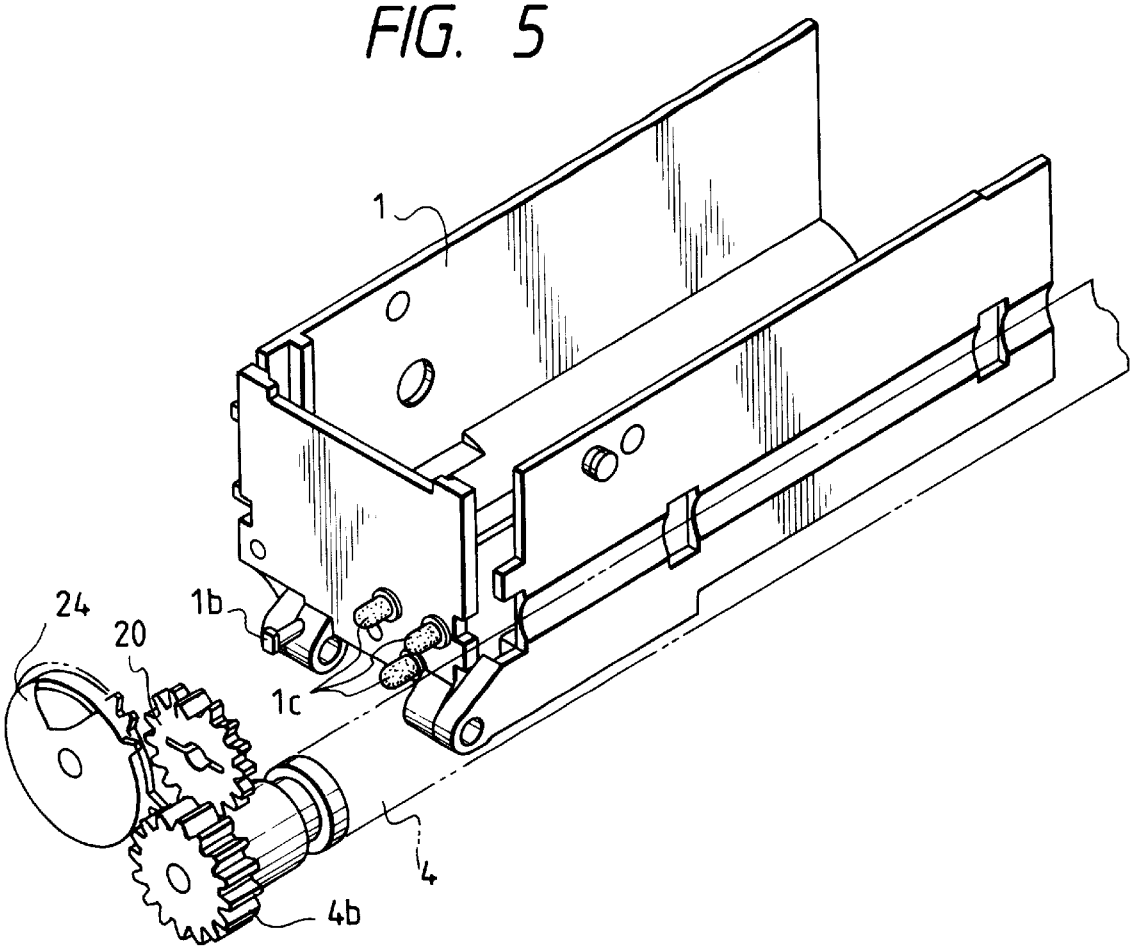
FIG. 5 is a view illustrating the end face of a carriage.
Figure 6:
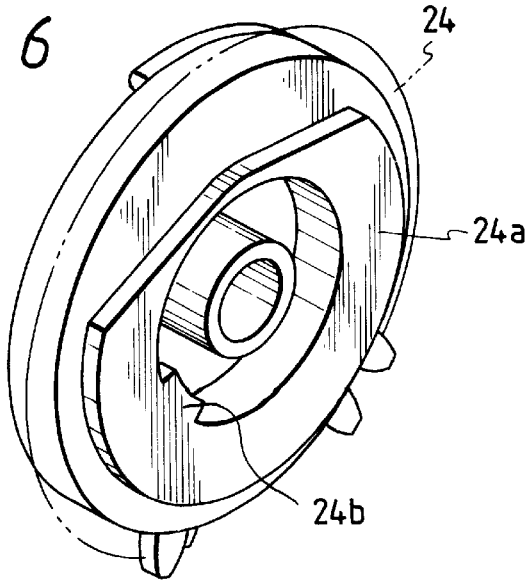
FIG. 6 is a view illustrating a timing gear.
Figure 7:
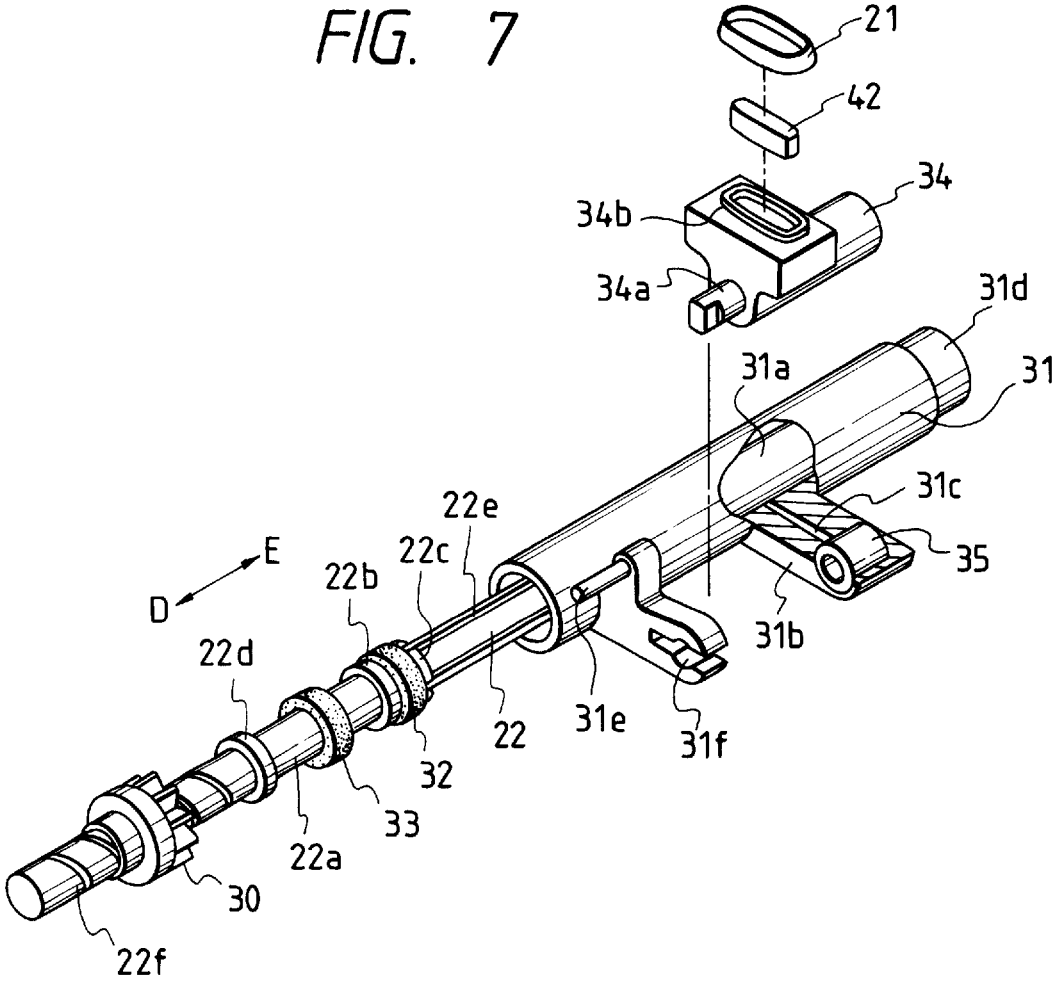
FIG. 7 is a detailed view showing a pump unit.
Figure 8:
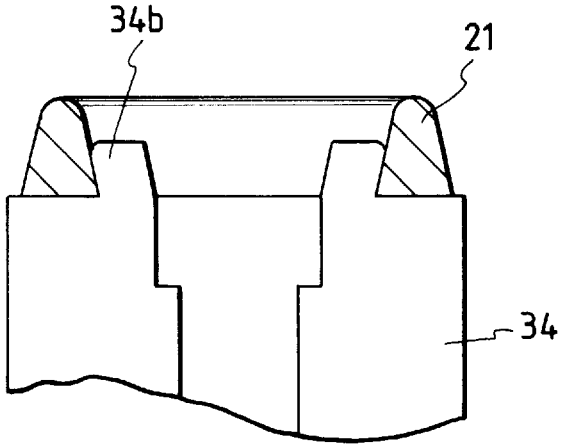
FIG. 8 is an enlarged cross-sectional view showing a cap.

With reference to the accompanying drawings, the description will be made of the embodiments of an ink jet recording apparatus for which the present invention is applied. In this respect, FIG. 1 is a perspective view illustrating the structure of a driving force transmission system as a first embodiment according to the present invention. FIG. 2 is a view illustrating the entire body of an ink jet recording apparatus. FIG. 3 is a view illustrating a motor pinion. FIGS. 4 to 6 are views illustrating the states of carriage traveling following the rotation of a lead screw. FIG. 7 is a view illustrating the structure of a recovery mechanism, and FIG. 8 is a view illustrating the structure whereby to mount the cap on the recovery mechanism.

To describe the entire body of an ink jet recording apparatus at first with reference to FIG. 2, an ink jet cartridge 2 comprising a recording head 2*a* and an ink tank 2*b* is mounted on a carriage 1. One end of this carriage 1 on the recording head 2*a* side is slidably fitted in a lead screw 4 in the axial direction of the shaft thereof which is rotatively mounted on a chassis 3 and then at the other end of the carriage 1, a guide (not shown) is provided. The structure is so arranged that the foregoing guide is slidably inserted in parallel with the axial direction of the lead screw 4 into a guide rail 3*c* formed on the chassis 3 so as to allow the carriage 1 to reciprocally travel in the axial direction of the lead screw 4 following its rotation while keeping the posture of the carriage constant at all times.

For the aforesaid lead screw 4, the lead gear 4*b* which is fixed to the one end of the lead screw on the left-hand side in FIG. 2 engages with a carrier motor pinion 20, serving as a driving force transmission member, mounted on the output shaft 25 of a carrier motor 5 while a lead pin 6 provided for the carriage 1 is inserted into a lead groove 4*a* formed spirally on the lead screw 4 at given pitches. Therefore, when the foregoing carrier motor 5 is normally rotated to cause the lead screw 4 to rotate the carriage 1 travels in the direction indicated by an arrow B in FIG. 2. Likewise, when the carriage motor 5 is reversely rotated, the carriage 1 travels in the direction indicated by an arrow C in FIG. 2. In this respect, the foregoing lead pin 6 is biased to the lead groove 4*a* of the lead screw 4 by means of a lead pin spring 7 in order to eliminate any gap with the lead screw 4.

Also, the aforesaid lead groove 4*a* is configured so that during the carrier motor pinion 20 transmits the rotational driving force to the lead screw 4, the discharging port surface 2*c* of the recording head 2*a* is at a standstill at a position facing a cap 21.

The recording head 2*a* is driven in synchronism with the reciprocation of the foregoing carriage 1 to eject ink in accordance with recording signals for the performance of recording on a recording material 8. In other words, this recording head 2*a* is provided with minute liquid discharging ports (orifices), liquid passages, and energy activation portions arranged on part of the liquid passages, and energy generating means to generate liquid droplet formation energy to activate liquid in the foregoing activation portions.

For energy generating means such as this, there are among others a recording method using electrothermal transducers such as piezoelectric elements, a method using an energy generating means wherein a laser or another electromagnetic wave generator is irradiated for heat generation thereby to cause liquid droplets to be ejected by means of such an exothermic effect, or a recording method using energy generating means wherein liquid is heated by means of electrothermal transducers such as exothermic elements having exothermic resistive bodies thereby to eject liquid.

Of these methods, a recording head used for an ink jet recording method in which liquid is ejected by means of thermal energy is capable of arranging in a high density the liquid discharging ports (orifices) for ejecting liquid to form recording droplets. Therefore, it is possible to perform a high resolution recording. Particularly, the recording head using electrothermal transducers as energy generating means can be fabricated compactly with ease, and further, for such a recording head, it is possible to utilize sufficiently the advantages of the IC technologies and micromachining techniques which have demonstrated the significant technological advancement and reliability in the semiconductor field in recent years. It has, therefore, an advantage that its high density assembly is easily manufactured at a reduced cost.

When the foregoing carrier 1 scans to conduct one-line recording, a recording material 8 is fed for one-line portion by feeding means to execute the next line recording. The feeding of the recording material 8 which faces the discharging port surface 2*c* of the recording head 2*a* is conducted in such a manner that the foregoing recording material 8 is brought into contact with the foregoing feed roller 9 by means of a pinch roller 10 which is in contact with the feed roller shown in FIG. 2 under pressure, and then by rotating the aforesaid feed roller 9 appropriately by means of a carrier motor 11 to carry the recording material to the recording portion as required. After recording, the recording material is discharged outside the apparatus by the cooperation of a spur 12 and a discharge roller 13 which is in contact with the spur 12 under pressure.

While the foregoing feed roller 9 and discharge roller 13 are driven by means of the carrier motor 11, its driving force is transmitted by means of the carrier motor pinion 14 which is a bevel gear mounted on the shaft of the aforesaid carrier motor 11, a bevel gear 15, a worm roller 16, a carrier wheel 17, and a discharge wheel 18. The rotational direction of the carrier pinion gear 14 is changed at right angles by means of the bevel gear 15 and its rotation is transferred to the worm roller 16 by the spur gear unit. On the fringe shaped portion 16*a* of the worm roller 16, a spiral type planar worm is formed (not shown) to engage with the carrier wheel 17 mounted on the feed roller 9 to drive the feed roller 9.

Also, the discharge roller 13 is driven by the engagement of the worm (not shown) formed on the cylindrical portion 16*b* of the worm roller 16 with the discharge wheel 18 mounted on the driving shaft 19 of the discharge roller.

In the reverse side of a platen 27 which is arranged on the reverse side of the recording surface and serves as a member to guide the recording material 8, there is stored a waste ink absorbent 28 to absorb waste ink discharged to a waste ink tube 31*d* by a pump unit 23 driven by the power transmission mechanism 24 which will be described later. This waste ink absorbent 28 is a flocculent polyester or the like, or a sponge and the like which can absorb and hold liquid in it.

Also, the waste ink tube 31*d* connected to the foregoing pump unit 23 is inserted into the waste ink absorbent 28 by an appropriate length.

On the left-hand side of the aforesaid feed roller 9 shown in FIG. 2, recovery means is provided for recovering the ink ejection function of the recording head 2*a*.

This recovery means is structured as shown in FIG. 1 with a cap 21 for capping the discharging port surface 2*c* of the recording head 2*a;* a pump unit 23 which serves to make the inner pressure of the cap negative to suck from the cap 21 the waste ink which has been forcibly discharged from the discharging port surface 2*c* and then to cause it to be flown into the waste ink tube 31*d,* and further, a power transmission unit (timing gear) 24 comprising the known cam and gear mechanism for transmitting the driving force required to move the foregoing cap 21 forward or backward with respect to the discharging port surface 2*c* as well as to drive the foregoing pump unit 23. Here, to the aforesaid timing gear 24, the rotational driving force of the carrier motor 5 is transmitted through the carrier motor pinion 20.

The aforesaid carrier motor pinion 20 is arranged to be coupled to the carrier motor 5 as set forth below. In FIG. 1, reference numeral 25 designates the output shaft of the carrier motor, which is made of metal such as carbo steel. On the output shaft 25, the carrier motor pinion 20 is slidably mounted in such a manner that the carrier motor pinion 20 can rotate when the motor 5 is driven.

More specifically, the inner diameter of the center hole 20*c* of the foregoing carrier motor pinion 20 is bored slightly greater than the outer diameter of the output shaft of the carrier motor so that it is slidably mounted in the axial direction of the output shaft 25. Also, in the center hole 20*c* of the carrier motor pinion 20, a groove 20*d* is provided as shown in FIG. 3. This groove 20*d* is slidably fitted with the protruded portion 25*d* formed on the output shaft 25 as shown in FIG. 1.

In this way, the foregoing pinion 20 engages with the lead gear 4*b* mounted on the lead screw 4, at the same time being capable of engaging with the timing gear 24 which drives the recovery means; thus transmitting the rotational force to the lead gear 4*b* and timing gear 24 when the carrier motor 5 is driven. Here, in FIG. 1, reference numeral 26 designates a gear stopper mounted at the end portion of the output shaft 25 so that the carrier motor pinion 20 will not fall off from the output shaft 25.

As shown in FIG. 3, the aforesaid carrier motor pinion 20 has one projected tooth 20*b* of the teeth 20*a* and this is used for triggering the rotation of the timing gear 24.

When a recording is in operation, the carrier motor pinion 20 is always biased in the direction toward the carriage 1 by the tension of a flat spring 29 as shown in FIG. 1. However, when the carriage 1 is caused to travel to the capping position (stand-by position) by the reverse rotation of the carrier motor 5, the carrier motor pinion 20 is depressed to the carrier motor 5 side (the left side in FIG. 1) in parallel by means of three pressure pins 1*c* formed on the end face 1*a* of the carriage 1 and is slidably shifted against the resilient strength of the flat spring 29. Thus, the carrier motor pinion 20 engages with a first tooth of the timing gear 24 through its triggering tooth 20*b*. Therefore, if the carrier motor 5 is reversely driven in a state where the carriage 1 has been shifted to the capping position the timing gear 20 which engages with the carrier motor pinion 20 is allowed to rotate. Hence, the recovery means is driven to start a series of the recovery operations.

In this respect, when the aforesaid carriage 1 is shifted to the capping position and the carrier motor pinion 20 engages with the timing gear 24, this pinion 20 maintains the engaging state with the lead gear 4*b*. Meanwhile, as shown in FIG. 4, the lead groove 4*a* of the lead screw 4 is formed to be a peripheral groove 4*c* on the left end portion of the lead screw 4 in parallel to its peripheral direction. Thus, when the carriage 1 is shifted to the aforesaid capping position, the lead pin 6 is allowed to be inserted into the peripheral groove 4*c*. As a result, after the carriage 1 has shifted to the capping position, the carriage 1 will no longer be shifted in the direction indicated by an arrow Q in FIG. 4 even if the lead screw 4 is rotated in the direction indicated by an arrow P in FIG. 4 with the reversal driving of the carrier motor 5. Hence, the driving force transmission is given only to the recovery means through the timing gear 24.

Also, after the aforesaid recovery operation is terminated, the lead pin 6 is withdrawn from the foregoing peripheral groove 4*c* and is coupled to the lead groove 4*a* when the carrier motor 5 is normally rotated so as to cause the lead screw 4 to rotate in the opposite direction indicated by an arrow P in FIG. 4. Thus, the carriage 1 travels in the direction indicated by an arrow B in FIG. 2.

At this juncture, in order to prevent the lead pin 6 from being shifted from the peripheral groove 4*c* to the lead groove 4*a* with any timing different from the regular timing, a hook 1*b* is provided on the side face of the timing gear 24 side of the carriage 1 as shown in FIG. 5, at the same time a stopper 24*b* being provided on the side face of the timing gear 24 on the carriage 1 side as shown in FIG. 6 for the purpose to stop the aforesaid hook lb. In this way, when the recovery operation is terminated and the carrier motor 5 is normally driven, it is controlled that the lead pin 6 will not be shifted from the peripheral groove 4*c* to the lead groove 4*a* with any timings other than the regulated timing.

Now, the description will be made of the structure whereby to drive the recovery means by the rotation of the foregoing timing gear 24.

For the timing gear 24, there are provided a cam 24*a* to open and close the cap, and a cam (not shown) to operate wiping. Then, as shown in FIG. 1 and FIG. 7, this timing gear 24 engages with a stroke gear 30 which reciprocates the plunger 22 which will be described later. When the timing gear 24 rotates, the stroke gear 30 rotates to allow the plunger 22 to be reciprocated.

Also, in FIG. 1, a reference numeral 36 designates a blade to wipe the ink discharging port surface 2*c* of the recording head 2*a* for cleaning the ink discharging port surface 2*c*. This blade 36 is made of HNBR or some other rubber and is mounted in such a manner that one end thereof is slidably inserted into the blade mounting groove 37*b* of a blade slider 37. In this respect, there is arranged for the blade mounting groove 37*b*, a protrusion having an acutely angled top to prevent the blade from falling out in a part of the direction in which the blade is protruded; thus making it possible for the blade 36 to withhold it by the interference of this protrusion when it is affected to be withdrawn.

For the blade slider 37, a through hole is provided so that it can travel along a slide shaft 40 in parallel with the discharging port surface 2*c* of the head. Thus, the blade 36 can reciprocate along the slide shaft 40 to keep its invasive amount constant at all times with respect to the discharging port surface 2*c* of the head 2*a* at any positions of the discharging port surface. Therefore, it can wipe the ink discharging port surface 2*c* evenly.

The foregoing reciprocation of the blade slider 37 is performed by means of a blade link 38. The blade link 38 can move vertically when the protrusion 38*a* thereof depresses the wall 37*a* of the blade slider. The movement of the blade link 38 is controlled by means of the wiping operation cam which formed on the timing gear 24. In the capping state, it is retracted to the lowermost point in the direction indicated by an arrow A in FIG. 1 (downward direction).

When the ink discharging port surface 2*c* of the recording head 2*a* is wiped by the movement of the foregoing blade slider 37, the ink which has adhered to the blade 36 is transferred to a blade cleaner 39 so that the blade 36 is maintained in a clean condition at all times. In other words, the blade 36 which has traveled in the direction A in FIG. 1 by the wiping operation is also in contact with this blade cleaner 39 after having completed wiping all the discharging port surface 2*c*. At this juncture, ink on the blade 36 is absorbed by the blade cleaner 39.

In this respect, if the blade 36 touches the blade cleaner 39 always, the blade 36 is deformed due to the creeping phenomenon of rubber and it will be disabled to display its aniticipated capability. Therefore, by means of a blade cam 41, the blade slider 37 is rotated to be retracted. The blade cam 41 controls the rotation of the blade slider 37 in the peripheral direction of the slide shaft 40. The arm 37*b* of the blade slider 37 is shifted while being in contact with the cam surface. Further, in order to avoid any reverse transfer of ink to the blade 36 due to the contact between the blade 36 and the blade cleaner 39, the blade passage is changed by means of a switching over valve or the like for its forward stroke and backward one.

Now, the structure of the pump unit 23 is that of a plunger pump as shown in FIG. 7.

In FIG. 7, a reference numeral 31 designates a cylinder having a cylindrical cylinder portion 31*a* and a guiding portion (not shown) to guide the planger portion 22 which will be described later. It has a partial cut-off in the axial direction to form an ink passage; 31*b,* a receptacle of a cap lever which is formed so that a lever seal 35, which will be described later, can be inserted.; 31*c,* an ink suction inlet with an opening at a given position; 31*d,* a waste ink tube having a waste ink absorbent 28 inserted into the leading portion integrally formed therewith; and also 31*e,* a protrusion to open and close the cap which enables the cap 21 to perform its open and close operations to be in contact airtightly with or apart from the ink discharging port surface 2*c* of the recording head 2*a* by the rotation of the cylinder 31 when the protrusion 31*e* is depressed by means of the cam 24*a* provided for the timing gear 24 to open and close the cap.

The plunger 22 is formed with an operational shaft 22*a,* a piston holder 22*b,* a piston receptacle 22*c,* and a pump seal holder 22*d.* Also, a groove 22*e* serving as an ink passage is formed continuously with the aforesaid operational shaft 22*a.* A part of this groove 22*e* is inserted into a guide portion (not shown) of the foregoing cylinder 31 to stop the rotation of the plunger 22. The operational shaft 22*a* is formed with a lead groove 22*f* to control the reciprocation of the plunger 22 and a protrusion (not shown) formed on the inner face of the stroke gear 30 is inserted into this lead groove 22*b.* Therefore, when the stroke gear 30 is rotated in one direction by the reverse rotation of the carrier motor 5, the plunger 22 is stroked in the direction indicated by an arrow D in FIG. 7. When the stroke gear 30 is rotated in the other direction by the normal driving of the carrier motor 5, the plunger 22 is stroked in the direction indicated by an arrow E in FIG. 7.

To the aforesaid plunger 22, the piston 32 made of NBR or some other rubber is mounted. The outer diameter of this piston 32 is made slightly larger than the inner diameter of the foregoing cylinder 31 by a given amount so that when inserted into the cylinder 31, it is compressed appropriately. In this way, when the plunger 22 is stroked in the direction indicated by an arrow D in FIG. 7, a negative pressure is exerted so as to absorb the waste ink in the recording head 2*a.* Then, when stroked in the direction indicated by an arrow E, the foregoing waste ink thus absorbed is discharged from the waste ink tube 31*d* to the absorbent 28.

To the aforesaid plunger 22, a pump seal 33 is mounted. This pump seal 33 is made of silicon rubber, NBR, or some other rubber. In order to obtain a given contact force between the seal and the plunger, the inner diameter of the seal is made slightly smaller than the outer diameter of the plunger 22. Also, it is possible for the seal to reciprocate in the cylinder 31 while being depressed by the pump seal holder 22*d* of the plunger 22 and the piston receptacle 22*c.* In this respect, a lubricant may be applied to the surface of the pump seal to reduce the sliding force exerted between the seal and the cylinder 31 and the plunger 22 as well.

Also, in FIG. 7, a reference number 34 designates a cap lever, and a cap lever seal 35 is biased by an ink guide (not shown) while the other rotational shaft 34*a* is mounted rotatively by snap fitting into the hole 31*f* of the cylinder 31. Into the cap lever seal 35, the ink guide of the cap lever 34 is inserted by compression and further, it is inserted into the cap lever receptacle 31*b* of the cylinder 31 by compression.

The cap 21 is a ring-shaped resilient member made of butyl chloride rubber or the like having a triangular cross-section and is mounted on the cap mounting portion 34*b* of the foregoing cap lever 34. As shown in FIG. 8, the mounting method thereof utilizes rubber resiliency effectively, and on the cap lever mounting portion 34*b* configured to follow the inclination of the triangular shape of the cap 21, the cap is mounted by expanding its ring. In this respect, once installed, the cap 21 is usually arranged so as not to be removed.

A reference numeral 42 designates a pad for preliminary ejection and is also made of a high molecular absorbent as in the foregoing blade cleaner 39. It is mounted on the aforesaid cap lever 34. The foregoing preliminary ejection pad is a pad to absorb the preliminary ejection ink which is ejected aside from the regular recording operation in order to prevent the drying of ink on the discharging port surface 2*c* in recording.

In a recording apparatus of the structure described above, the carrier motor pinion 20 slidably mounted on the output shaft 25 of the carrier motor engages with the lead gear 4*b* of the lead screw 4. When the carrier motor 5 is driven normally or reversely in this state, the carriage 1 reciprocates to perform a given recording.

On the other hand, when the carriage 1 is shifted to the capping position, the carrier motor pinion 20 is shifted to engage with the timing gear 24. When the carrier motor 5 is normally or reversely driven in this state, the blade 36 of recovery means wipes the ink discharging port surface 2*c* of the recording head 2*a,* at the same time the cap 21 being sucked to the ink discharging port surface 2*c.* Then, the plunger 22 is shifted to suck the waste ink in the recording head 2*a.*

Thus, with the shift of the carrier motor pinion 20, it becomes unnecessary to provide a clutch gear as in the conventional technique for switching over between shifting the carriage 1 and driving the recovery means.

Figure 9:
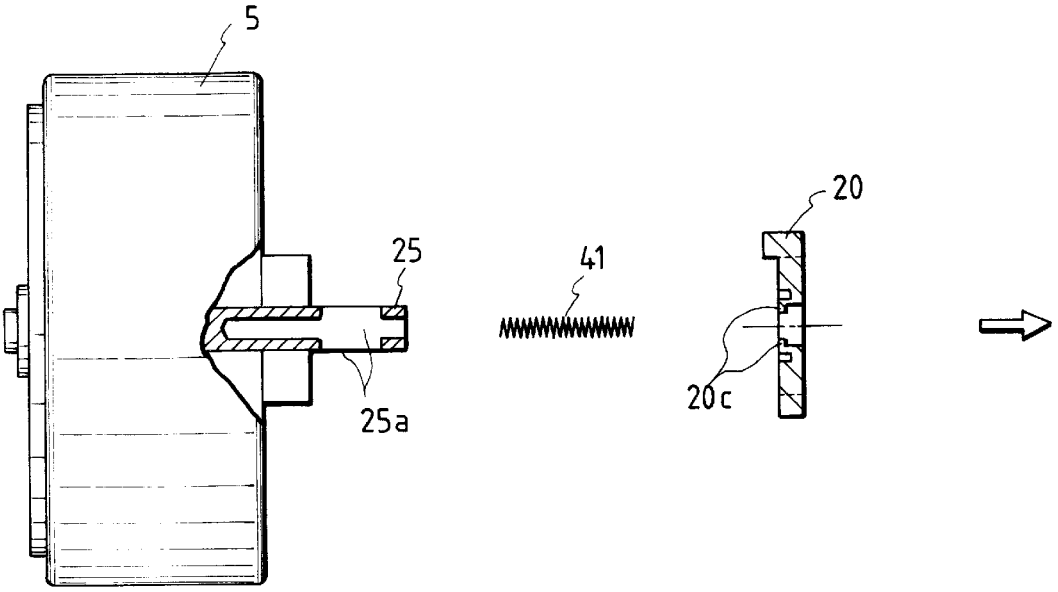
FIG. 9 is a view showing a second embodiment according to the present invention in which an illustration is made of an embodiment wherein a carrier motor pinion is biased by means of a compression coil spring installed in an output shaft.

While in the foregoing first embodiment there has been shown an example wherein the carrier motor pinion 20 is biased by means of the flat spring 29, it may be possible to structure it as shown in FIG. 9 as a second embodiment.

In the second embodiment, the output shaft 25 of the carrier motor is of a hollow structure with its central portion having been bored. An elongated hole 25*a* is provided for two locations at designated positions on this output shaft 25. Meanwhile, two protrusions 20*c* are proved in the center hole of the carrier motor pinion 20 to face those two locations. Then, the foregoing protrusions 20*c* are inserted into the elongated holes 25*a* on the carrier motor output shaft 25 in a state that they do not fall off. In this case, the carrier motor pinion 20 can travel within the range in the longitudinal direction of the aforesaid elongated hole 25*a;* hence enabling the carrier motor pinion 20 to reciprocate in the axial direction of the carrier motor output shaft 25.

Then, into the foregoing hollow output shaft 25, a compressed coil spring 41 is inserted to depress the protrusion 20*c* of the carrier motor pinion 20 for biasing the carrier motor pinion 20 in the recording direction (direction indicated by an arrow in FIG. 9).

Thus, it is possible to use a compressed coil spring 41 in order to allow the carrier motor pinion 20 to slide as in the first embodiment; hence enabling it to function as a clutch gear.

Figure 10:
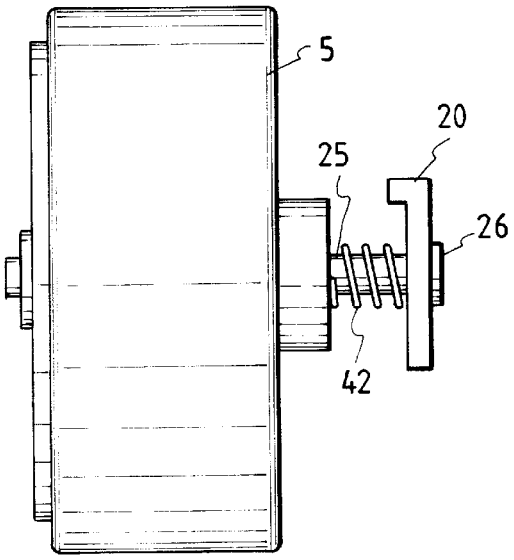
FIG. 10 is a view showing a third embodiment according to the present invention in which an illustration is made of an embodiment wherein a carrier motor pinion is biased by means of a compression coil spring mounted on the outer periphery of an output shaft.

Also, not only the compressed coil spring can be incorporated in the output shaft 25, but also it can be installed on the periphery of the carrier motor output shaft 25 as shown in FIG. 10 as a third embodiment according to the present invention for the same purpose. In other words, in the third embodiment shown in FIG. 10, the compressed coil spring 42 is mounted to cover the outer periphery of the carrier motor output shaft 25 to compress the carrier motor pinion 20. Here, a reference numeral 26 designates a gear stopper.

Furthermore, not only the bias is exerted by means of a spring member as in the first embodiment to the third embodiment, but also can a bias be given by the application of magnetic force or the like.

Figure 11:
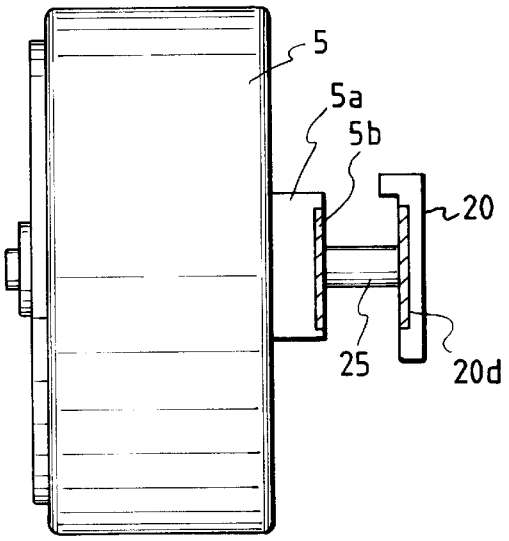
FIG. 11 is a view showing a fourth embodiment according to the present invention in which an illustration is made of an embodiment where a carrier motor pinion is depressed by means of magnetic force.

For example, as a fourth embodiment according to the present invention, it is possible as shown in FIG. 11 to provide portions 20*d* and 5*b* (slashed parts) where magnetic force is generated by means of a magnet or the like for the carrier motor pinion 20 and the fringe 5*a* of the carrier motor 5 and then by making the facing planes the same polarity so that the carriage motor pinion 20 is caused to depress the carriage 1 side at all times due to the magnetic repulsion.

As described above in detail, according to the first embodiment to the fourth embodiment, the member to transmit the driving force to the carriage is structured to be shiftable and when the carriage is shifted to the position where recovery means is located, the aforesaid driving force transmission member is shifted to the position where it can transmit the driving force to the recovery means. As a result, a clutching function is obtained; thus making it unnecessary to employ any of the clutch gears conventionally required. Hence, at the same time that the number of parts is reduced to implement a cost down, it becomes possible to structure the apparatus more compactly.

Figure 12:
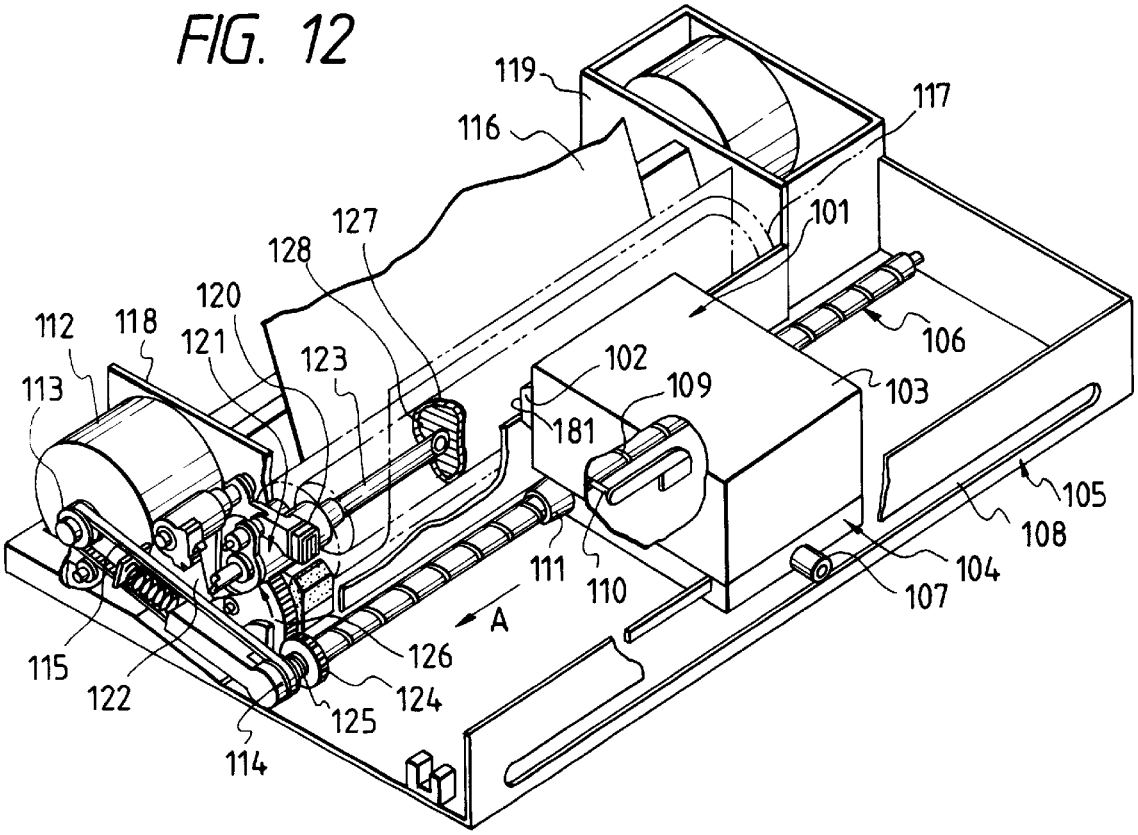
FIG. 12 is a partially cut-off perspective view showing the structure of the principal part of an ink jet recording apparatus as an embodiment for which the present invention is applied.

Hereinafter, the description will be made still more of the other embodiments according to the present invention. FIG. 12 is a partially broken perspective view schematically showing an ink jet recording apparatus as another embodiment for which the present invention is applied. In FIG. 12, recording means (a recording head) 101 is formed with an exchangeable cartridge fabricated integrally with the recording head unit 102 and an ink tank 103. The aforesaid cartridge 101 is mounted on a carriage 104. The end portion of the carriage 104 on the recording head unit 102 side is fitted into a lead screw 106 rotatively supported by a chassis 105 in such a fashion that it can be reciprocated in the axial direction of the lead screw. Also, on the end portion of the carriage 104 on the other side, a guide roller 107 is axially supported and then the foregoing guide roller 107 is inserted into a guide rail 108 formed on the chassis 105.

On the carriage 104, a protrusion (or a pin) 110 is provided to engage with the spiral lead groove 109 formed on the lead screw 106. In FIG. 12, the foregoing protrusion 110 is resiliently biased into the foregoing lead groove 109 by use of a flat spring or other biasing means so that both of them engage with each other assuredly. Thus, the structure is arranged so that the carriage 104 can reciprocate reliably following the rotation of the lead screw 106 in the axial direction of the foregoing lead screw 106.

The aforesaid lead screw 106 is driven by the rotation of a driving motor 112 through a driving belt 115 tensioned between the pulley 113 which is fixed to the output shaft thereof and the pulley 114 which is fixed to the end portion of the lead screw 106. Then, the traveling direction of the carriage 104 is controlled by the normal or reverse rotation of the lead screw 106 with the driving direction control of the motor 112.

A recording material 116 such a recording sheet or a thin plastic plate is carried by a feed roller 117 (for sheet feeding) through a position (recordable position) facing the recording head unit 102 of the cartridge 101. In an apparatus shown in FIG. 12, the foregoing feed roller 117 is of a hollow cylindrical type, and the both ends thereof are axially and rotatively supported by a first side plate 118 vertically provided at one position of the chassis 105 on the left side in FIG. 12 and a second side plate 119 provided at one position of the chassis 105 on the right side in FIG. 12. Also, the interior of the hollow cylindrical type feed roller 117 is structured to be conductively connected to the atmospheric air.

The aforesaid recording head (recording head=cartridge) 101 is ink jet recording means utilizing thermal energy for ink ejection. This means is provided with electrothermal transducers for generating thermal energy. Also, the foregoing recording head 101 utilizes the changing pressures attributable to the development and contraction of bubbles created by the thermal energy applied by the foregoing electrothermal transducers; thus ejecting ink from the discharging ports for recording.

Figure 13:
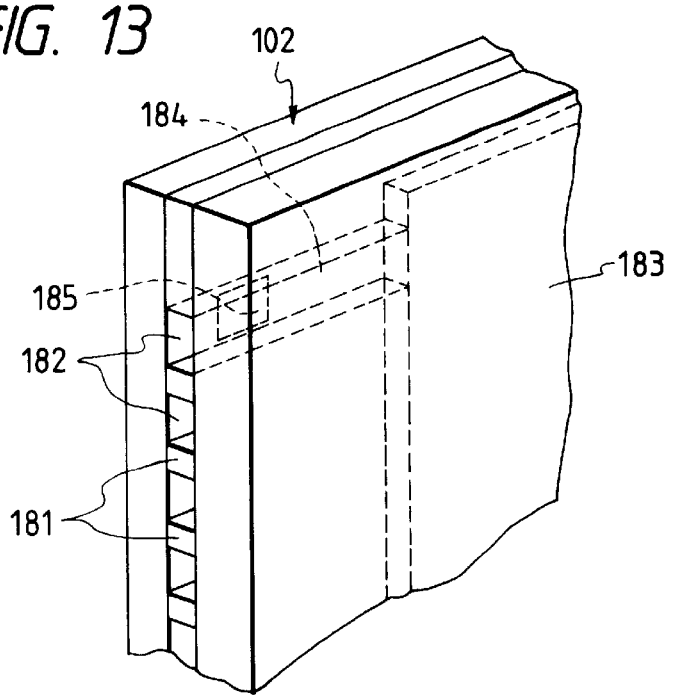
FIG. 13 is a partially perspective view schematically showing the structure of an ink discharging portion of recording means shown in FIG. 12.

FIG. 13 is a partially perspective view schematically showing the structure of the ink discharging ports unit of the foregoing recording head 101. In FIG. 13, a plurality of discharging portions 182 are formed at a given pitches on the discharging portion formation surface 181 facing a recording material 116 with a given space (approximately 0.5 to 2.0 mm, for example), and along walls of the respective liquid passages 184 which conductively connect a common liquid chamber 183 and each of the discharging ports 182, electrothermal transducers (exothermic resistive elements or the like) 185 are arranged for generating energy to eject ink. In the apparatus shown in FIG. 12, the recording head 101 is mounted on the foregoing carriage 104 with a positional relation that the foregoing discharging ports 182 are arranged in the direction intersecting the scanning (traveling) direction of the carriage 104. Thus, the recording head 101 is structured to drive (energize) the corresponding electrothermal transducers 185 in accordance with image signals or ejection signals so as to give film boiling to ink in the liquid passages 184, and then with the pressures thus exerted at that time, ink is caused to be ejected from the discharging ports 182 for recording.

In FIG. 12, on the left-hand side of the aforesaid feed roller 117, there is arranged a recovery device to recover the ink ejecting function of the recording head unit 102. This recovery device is provided with a cap (capping unit) 120 for capping the discharging port formation surface 181 of the recording head 101; a pump mechanism 121 for making the interior of the foregoing cap 120 negatively pressurized; a driving force transmission mechanism 122 comprising cams, gears, and others; and a waste ink tube 123 connected to the pump mechanism 121. The aforesaid pump mechanism 121 operates to make the interior of the cap 120 negatively pressurized to forcibly withdraw ink from the discharging ports 182 and then, from the cap 120, the ink thus withdrawn is sucked and further, the ink thus sucked is flown into the waste ink tube 123. Also, the aforesaid driving force transmission mechanism 122 serves to shift the cap 120 forward or backward with respect to the discharging port formation surface 181 by the rotational driving force of the lead screw 106 obtained through a clutch gear 124 or to transmit a driving force to the pump mechanism 121.

The aforesaid clutch gear 124 is mounted on the lead screw 106 slidably in its axial direction through a rotation stopping means such as a sprain groove, and by means of a spring 125, it is always biased in the direction toward the carriage 104. This clutch gear 124 is shifted in the direction indicated by an arrow A in FIG. 12 against the biasing power exerted by the spring 125 to engage with the timing gear 126 of the driving force transmission mechanism 122 when the carriage 104 is shifted from a position shown in FIG. 12 in the direction indicated by the arrow A so that the clutch gear is depressed in the direction indicated by the arrow A with the depressing portion 111 provided for the carriage 104. When the clutch gear 124 engages with the timing gear 126 in this way, the rotational driving force of the lead screw 106 can be transmitted to the driving force transmission mechanism 122 when the foregoing timing gear 126 is rotated in the direction indicated by an arrow B.

The lead groove 109 of the foregoing lead screw 106 is formed to enable the carriage 104 to stop at a position where the discharge port formation surface 181 can face the cap 120 when the clutch 124 is engaged in transmitting the rotational driving force of the lead screw 106. In the hollow cylindrical feed roller 117, there is arranged an ink absorbent 128 which is filled in a thin cylindrical covering member 127. The ink which has been flowed into the waste ink tube 123 from the pump mechanism 121 driven by the driving force transmission mechanism 122 is absorbed into the foregoing ink absorbent 128.

The aforesaid ink absorbent 128 is made of a flocculent material having excellent ink absorption such as polyester. Also, the aforesaid covering member 127 is formed with a plastic material such as polyethylene or EVA. In this respect, this covering member 127 is positioned in the feed roller 117 and then one end of the covering member 127 is fixed to the part of the pump mechanism 121 while the other end thereof is fixed to the second wall plate 119. Also, the waste ink tube 123 connected to the pump mechanism 121 is inserted into the ink absorbent 128 along the center line of the covering member 127 by a given length.

Figure 14:
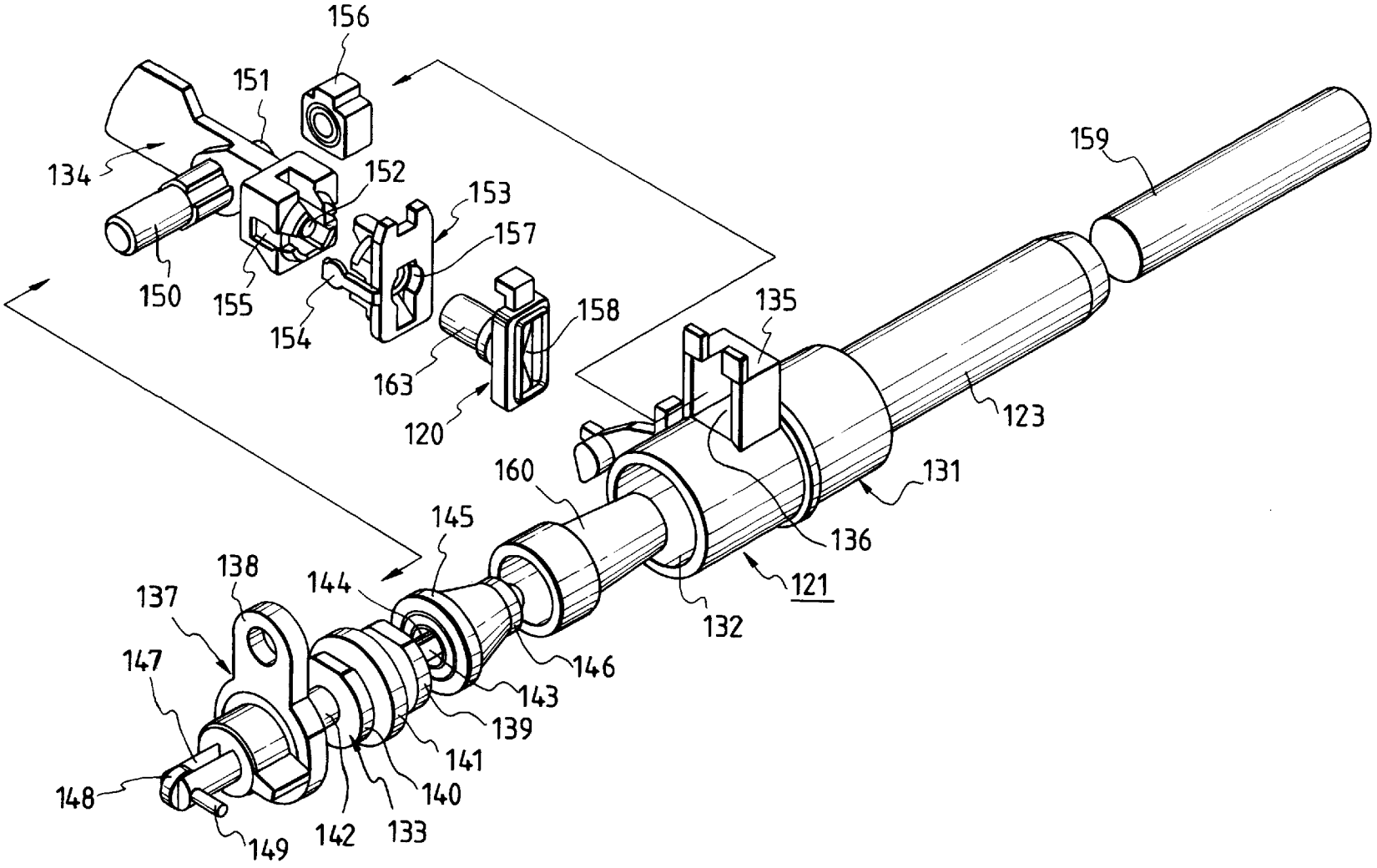
FIG. 14 is a exploded view showing the structure of a ejection recovery system according to a fifth embodiment of the present invention.

FIG. 14 is an exploded perspective view showing the structure of an ink suction system as a fifth embodiment according to the present invention, comprising a pump mechanism 121, a cap 120, and others. The illustrated pump mechanism is of structure of a plunger pump. In FIG. 14, there are provided for the cylinder 131 of the pump mechanism 121, the cylinder portion 132 formed with a cylindrical bore; a guide portion (not shown) to guide a piston shaft 133; and an ink passage formed by cutting off the foregoing piston shaft 133 partially in its axial direction. On the surface of the foregoing cylinder 131, a cap lever receptacle 135 is provided to allow a cap lever 134 to be fittingly mounted. Also, on the aforesaid cap lever receptacle 135 of the cylinder 131, an ink suction inlet 136 is formed. Further, at the end portion of the cylinder 131 on the right-hand side in FIG. 14, the foregoing waste ink tube 123 is integrally formed. The leading end of the waste ink tube 123 is inserted into the ink absorbent 128 (FIG. 12).

In FIG. 14, in the opening end face of the foregoing cylinder 131 on the left-hand side, a cylinder cap 137 is inserted by compression. At the position where this cylinder cap 137 faces the foregoing cap lever receptacle 135, a lever guide portion 138 is formed. For the piston shaft 133, a flange type piston holder 139 and a piston seal holder 140 are integrally formed at a given interval at a position in the axial direction of the shaft. On the axial portion between the piston holder 139 and the piston seal holder 140, a seal member (piston seal) 141 is fitted on the cylinder portion 132 slidably in the axial direction. This seal member 141 is made of silicon rubber, NBR or some other rubber type resilient material. In this respect, a structure may be arranged so as to coat a lubricant over the surface of the seal member 141 for the reduction of the sliding friction between the seal and the cylinder portion 132 as well as with the piston shaft 133.

On the aforesaid piston shaft 133, there are integrally formed, an operational shaft 142 on the left end side and a connecting shaft 143 on the right side portion, respectively in FIG. 14, in addition to the foregoing piston holder 130 and piston seal 140. This connecting shaft 143 is formed on the right-hand side of the piston holder 139. Also, on this connecting shaft 143, an axial groove 144 is formed to serve as an ink passage. Here, on the foregoing connecting shaft 143, the piston 145 is slidably fitted in the axial direction while the piston receptacle 146 is fixed to the leading end of the connecting shaft 143. Thus, the piston 145 is installed in such a manner that it is slidably shiftable in the cylinder portion 132 in accordance with the movement of the piston shaft 133, and at the same time, it can be shifted in the axial direction by a given amount between the aforesaid piston holder 139 and piston receptacle 146. In this respect, the piston 145 is made of NBR or some other rubber type resilient member. Its outer diameter is made slightly larger than the inner diameter of the cylinder portion 132 so that it is fitted with an appropriate tension exerted (that is, in a compressed state) between the piston and the foregoing cylinder portion 132.

On the piston shaft 133, a groove 147 is formed, which engages with a protrusion on the inner periphery of the foregoing cylinder cap 137 in order to stop the rotation of the piston shaft 133. Also, at the end portion of this piston shaft 133 on the left-hand side in FIG. 14, a piston compression roller 148 and a piston restoration roller shaft 149 are rotatively and axially supported, respectively.

For the aforesaid cap lever 134, a rotational shaft 150, ink guide portion 151, lever guide portion (not shown), and others are provided. Also, at the leading end of this cap lever 134, a sealing portion 152 is provided, in which the tube portion 163 of the cap 120 is incorporated with this sealing portion 152 airtightly. Further, on both sides of this cap lever 134, coupling portions 155 are formed to couple with the hook portion 154 of a cap holder 153. In the aforesaid cap lever 134, there is formed an ink passage (not shown) from the foregoing sealing portion 152 through its inner part. The passage is bent substantially at right angles on its way and is opened to the center of the end portion of the foregoing ink guide portion 151.

On the aforesaid ink guide portion 151, a lever seal 156 is fittingly mounted under compression. This lever seal 156 is inserted into the cap lever receptacle 135 of the cylinder 131 fittingly under compression. In this lever seal 156, an ink passage (not shown) is formed to connect the ink passage in the cap lever 134 and the ink suction inlet 136 of the cylinder 131. On both sides of the foregoing cap holder 153, hook portions 154 are formed to engage with the coupling portions 155 on both sides of the foregoing cap lever 134. Also, this cap holder 153 has an opening 157 for mounting the cap 120.

The cap 120 closes airtightly the discharging port formation surface 181 of the recording head 101, thus preventing ink in the discharging ports 189 from being dried as well as dust particles from adhering to the vicinity of the discharging ports 189. In the cap 120, the suction inlet 158 is opened. Through the ink passage (not shown) in the cap 120, this suction inlet 158 is connected to the ink passage in the cap lever 134 which has its opening in the foregoing sealing portion 152. The tube portion 163 of the foregoing cap 120 is fitted into the opening portion 157 of the cap holder 153. Then, the cap is mounted on the cap holder 153 simultaneously in such a state that the end face of the foregoing tube portion 163 is in contact airtightly with the sealing portion 152 of the cap lever 134.

In the aforesaid waste ink tube 123, a cylinder absorbent (ink absorbent) 159 is mounted. This cylinder absorbent 159 serves to carry (transfer) the reservoired ink (waste ink) in the cylinder 131 to the foregoing ink absorbent 128 (FIG. 12). Also, in the cylinder 131, a piston absorbent (ink absorbent) 160 is mounted. This piston absorbent 160 serves to carry (transfer) the ink exhausted from the piston 145 to the foregoing cylinder absorbent 159.

Figure 15:
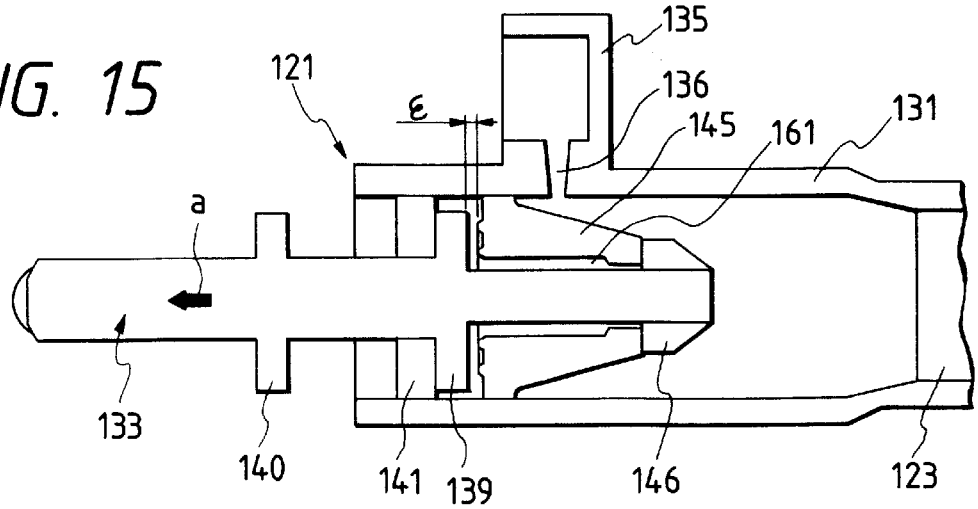
FIG. 15 is a vertically sectional view showing the stand-by state of a pump mechanism shown in FIG. 14.

FIG. 15 to FIG. 19 are vertically sectional views schematically showing a series of operations of the pump mechanism set forth above. Now, with reference thereto, the description will be made of the series of the operations of the pump mechanism 121 from its ink suction to ink exhaust. At first, FIG. 15 illustrates the stand-by state of the pump mechanism 121. This state is such that the piston shaft 133 has returned to a predetermined standby position after shifted in the direction indicated by an arrow a in FIG. 15 from the position where the ink exhaust, which will be described later, is terminated. At this juncture, the piston 145 is brought to the upper dead point side by means of the piston receptacle 146. Likewise, the piston seal (sealing member) 141 is brought to the upper dead point side by means of the piston holder 139. In this respect, a reference mark $\epsilon$ in FIG. 15 designates a gap (shiftable distance) between the piston receptacle 146 and the piston holder 139 in the axial direction of the piston 145.

Figure 16:
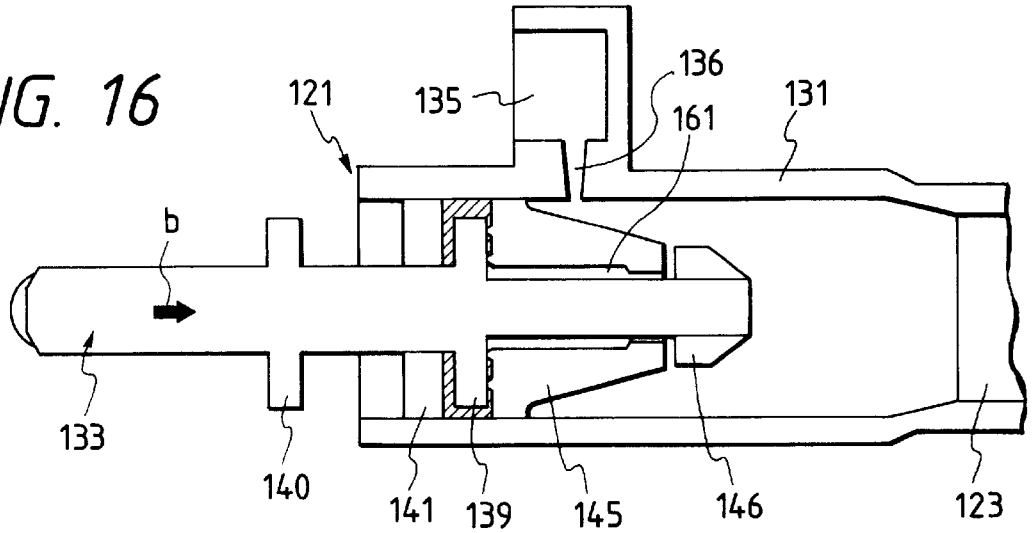
FIG. 16 is a vertically sectional view showing the initial state of the pump mechanism shown in FIG. 15 under negative pressure.

FIG. 16 illustrates the initial state of negative pressure. This state is such that the piston shaft 133 has shifted in the direction indicated by an arrow b by an amount of the gap at $\epsilon$. At this juncture, the piston 145 and piston seal (sealing member) 141 are not changed from the stand-by state shown in FIG. 15 and remain at the same positions. However, the piston 145 is closely in contact with the piston holder 139 and the hashed portion indicates an airtight space. This slanted portion represents the initial volume of the pump mechanism 121.

Figure 17:
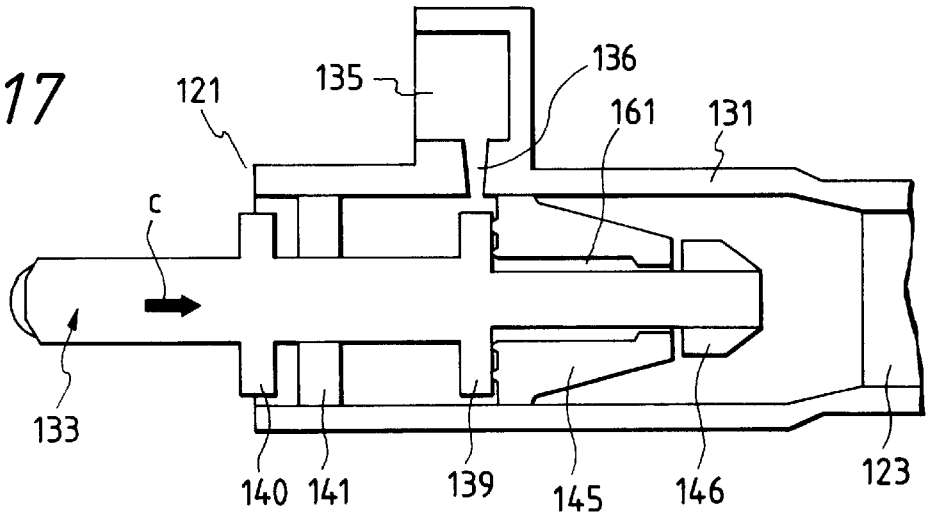
FIG. 17 is a vertically sectional view showing the state where the suction by the pump mechanism shown in FIG. 15 is suspended.

FIG. 17 illustrates the state where the suction is at rest. When the piston shaft 133 advances further in the direction indicated by an arrow c in FIG. 17 from the initial state of negative pressure shown in FIG. 16, the volume of the airtight space represented by the hashed portion in FIG. 16 increases gradually and the negative inner pressure also increasingly becomes greater. Then, when the piston 145 passes the ink suction inlet 136, the aforesaid negative pressure is transmitted to the discharging ports 189 of the recording head 101 through the cap 120. Hence, ink is sucked from the discharging ports 189. After that, the piston shaft 133 is shifted in the direction indicated by an arrow c and then the piston seal holder 140 is once stopped at the position where it is in contact with the piston seal (sealing member) 141. FIG. 17 illustrates the state that the piston shaft 133 thus comes to a standstill temporarily.

Figure 18:
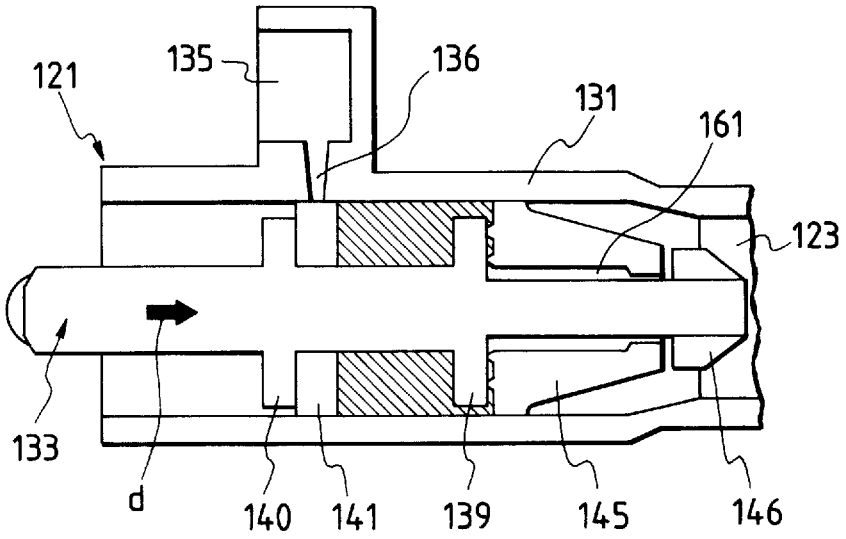
FIG. 18 is a vertically sectional view showing the state where the empty suction by the pump mechanism shown in FIG. 15 is suspended.

FIG. 18 illustrates a state that an empty suction is at rest. Here, empty suction means a process to suck into the cylinder 131 the ink which remains in the liquid passage between the ink suction inlet 136 and the cap 120. This empty suction is an operation to prevent the ink leakage from the cap 120 due to any contra-flow of ink in the passage. From the state represented in FIG. 17 where the suction is at rest, the piston shaft 133 is further shifted in the direction indicated by an arrow d in FIG. 18. Then, the piston 145 is depressed in the direction indicated by the arrow d by the piston holder 139. Likewise, the piston seal (sealing member) 141 is depressed in the direction indicated by the arrow d by the piston seal holder 140. Thus, both of them are shifted in the direction indicated by the arrow d. In this way, as shown in FIG. 18, the piston seal (sealing member) 141 closes the ink suction inlet 136. When the above-mentioned empty suction is completed, the piston shaft 133 is suspended.

During this empty suction, the cap 120 is released away from the discharging port formation surface 181; hence allowing air to be sucked from the cap 120 to the cylinder 131. Therefore, when the empty suction is at rest as shown in FIG. 18, there is no ink remaining in the passage from the ink suction inlet 136 to the cap 120. Also, the ink which is absorbed in the cylinder 131 is reservoired in the closed space represented by the hashed portion in FIG. 18.

Figure 19:
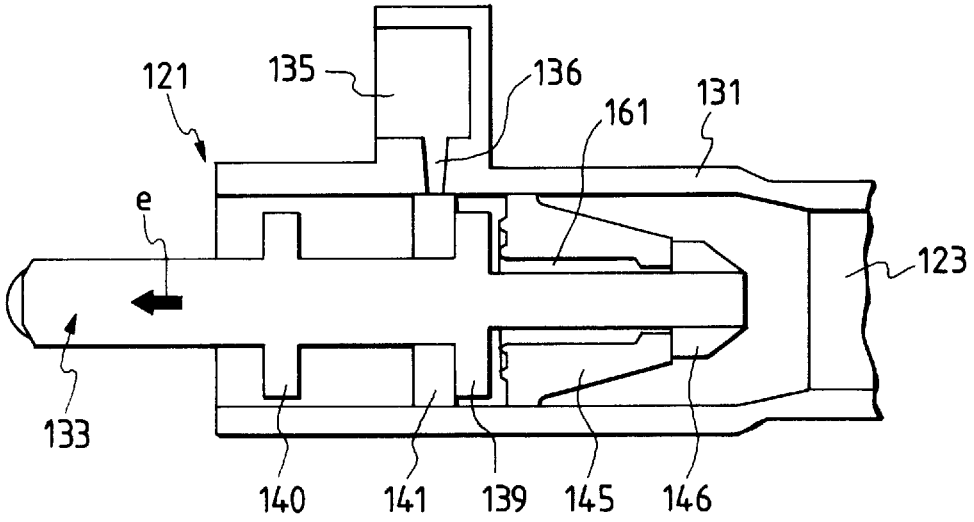
FIG. 19 is a vertically sectional view showing the state where the ink exhaust by the pump mechanism shown in FIG. 15 is terminated.

FIG. 19 illustrates a state where the exhaust is terminated. When the piston shaft 133 is shifted from the position where the idle suction is suspended in FIG. 18 in the direction indicated by an arrow e in FIG. 19 (returning direction= opposite direction), the piston 145 is depressed by the piston receptacle 146 to travel in the direction indicated by the arrow e accordingly. At this juncture, the piston seal (sealing member) 141, being shiftable with respect to the piston shaft 133, is still at a standstill to close the ink suction inlet 136 at the position where the empty suction is suspended as shown in FIG. 18. Also, at this time (when the piston shaft 133 is shifted in the direction indicated by the arrow e), the piston 145 is apart from the piston holder 139. Thus, the ink exhaust passage 161 formed between the foregoing piston 145 and piston shaft 133 (connecting shaft 143) becomes conductive (released). As a result, the ink which is reservoired in the hashed portion between the piston 145 and piston seal (sealing member) 141 in FIG. 18 flows from the aforesaid ink exhaust passage 161 to the waste ink tube 123 along with the shift of the piston shaft 133 in the direction indicated by the arrow e.

The ink which flows into the waste ink tube 123 (waste ink) is transferred to the ink absorbent 128 through the cylinder absorbent 159 (FIG. 14). Thus, ink in the cylinder 131 is removed neatly. Subsequently, when the piston shaft 133 is further shifted in the direction indicated by the arrow e, it is returned to the stand-by state as shown in FIG. 15. With the suspension of the piston shaft 133 in this stand-by state, this series of the pump operations (ink suction and exhaust operations) is terminated. In this respect, in order to conduct the ink exhaust from the cylinder more reliably, it may be possible to reverse the traveling direction of the piston shaft 133 in the state shown in FIG. 19 so as to shift the foregoing piston shaft 133 once in the direction opposite to the direction indicated by the arrow e, and then it is returned to the standby state shown in FIG. 15 after the ink reservoired in the waste ink tube 123 side has been forcibly transferred to the cylinder absorbent 159.

Figure 20:
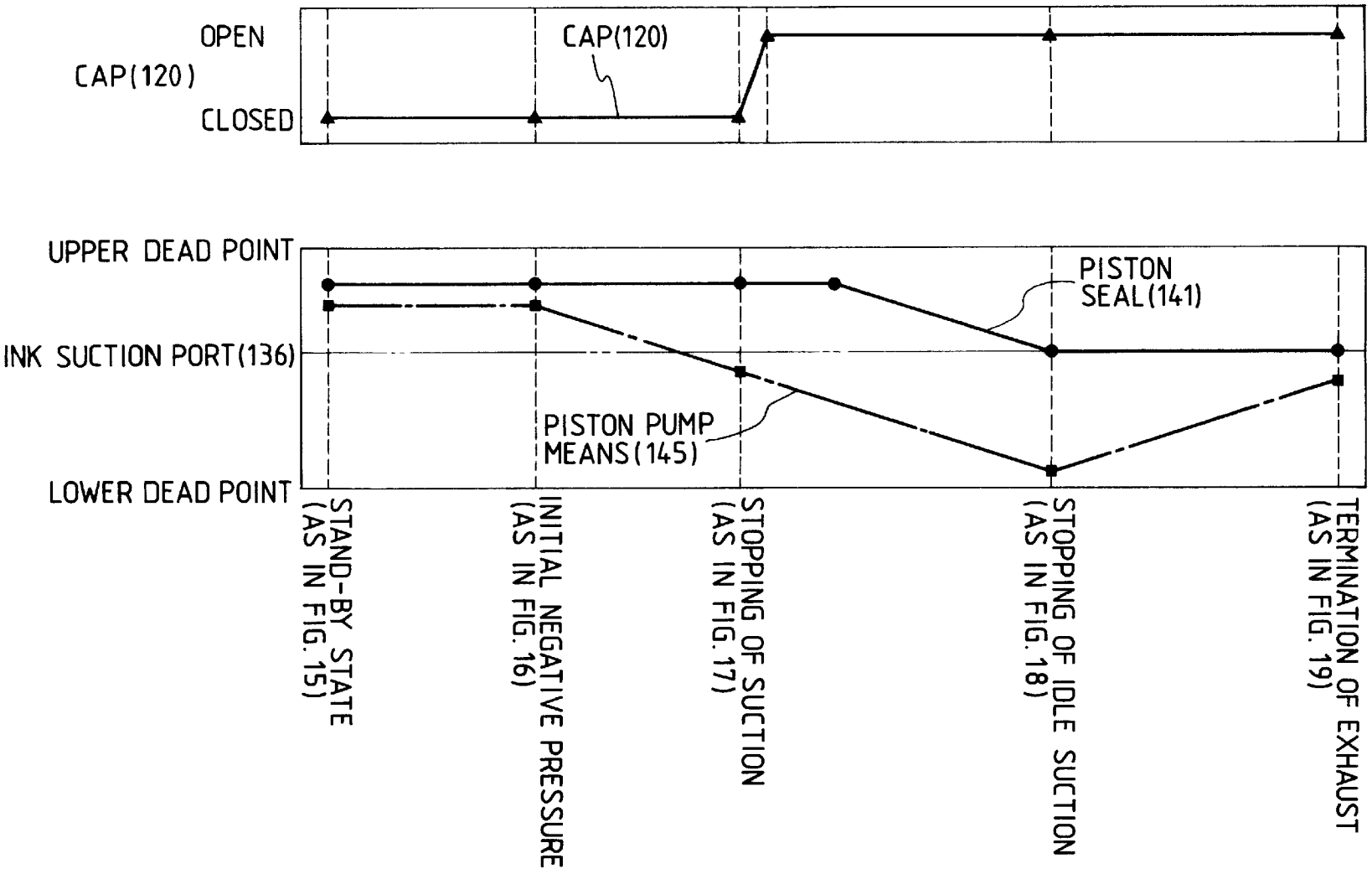
FIG. 20 is a timing chart showing the sequence of the suction operation of the pump mechanism shown in FIG. 15.

FIG. 20 is a timing chart showing the operational sequence of the operations of the pump mechanism 121 shown in FIG. 15 to FIG. 19 as well as the open and close of the cap 120. In FIG. 20, the upper dead point side of the piston 145 and piston seal (sealing member) 141 means the position on the left-hand side as shown in FIG. 15 while the lower dead point side means the position on the right-hand side as shown in FIG. 18. Also, the open state of the cap 120 means the state where it is apart from the discharging port formation surface 181 while the close state means the state where it is in contact with the discharging port formation surface 181 to cover the discharging ports 182 airtightly.

Figure 21:
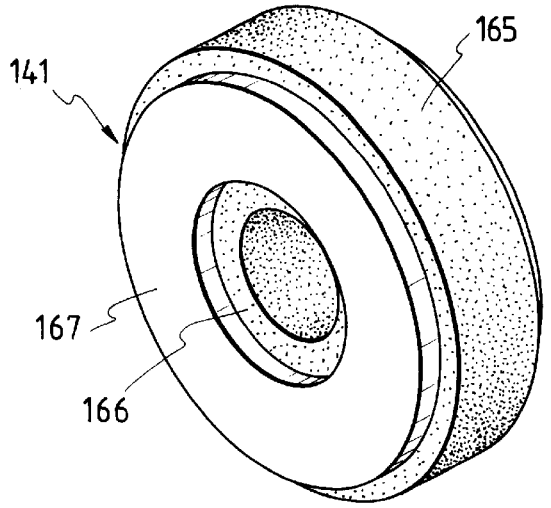
FIG. 21 is a perspective view showing the structure of a sealing member (piston seal) shown in FIG. 15 as a sixth embodiment according to the present invention.

FIG. 21 is a perspective view showing another structural example of the foregoing piston seal (sealing member) 141 as a sixth embodiment according to the present invention. The piston seal 141 shown in FIG. 21 is of such a structure that the sliding portion 165 in contact with the cylinder portion 132 and the sliding portion 166 in contact with the piston shaft 133 are formed with a rubber type resilient material such rubber, and the portions other than those (main body) 167 are formed with a metal, hard plastic, or other rigid material. With a piston seal 141 of such a structure as this, it is possible to eliminate any compression buckling and warping of the piston seal 141 even when a large (intensified) negative pressure is generated by the pump mechanism 121. Hence, leakage from the piston seal 141 portion can be easily eliminated, and the negative pressure and suction amount by the pump mechanism 121 can be stabilized; thus enabling the reliability of the recording apparatus to be enhanced.

Figure 22:
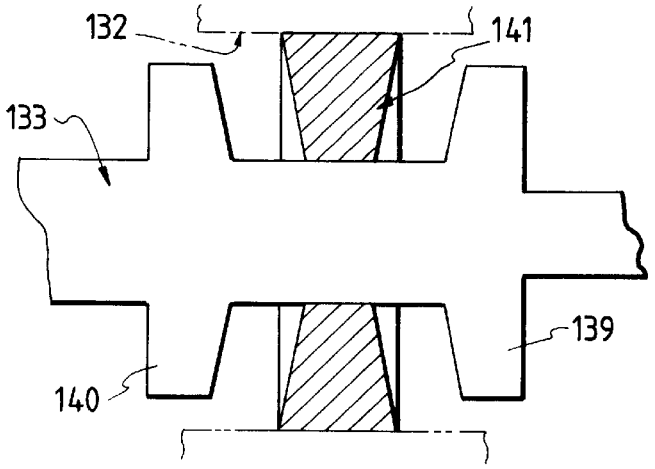
FIG. 22 is a vertically sectional view partially showing the structure of the sealing member and piston shaft shown in FIG. 15 as a seventh embodiment according to the present invention.

FIG. 22 is a vertically sectional view partially showing the piston seal (sealing member) 141 and piston shaft 133 as a seventh embodiment according to the present invention. In FIG. 22, the piston seal 141 is conically shaped on both ends thereof as shown in FIG. 12. Accordingly, the side faces (holding surfaces) of the piston holder 139 and piston seal holder 140 of the piston shaft 133 are also conically shaped. With a configurational structure such as this, it is possible to increase the contacting area of the cylinder portion 132 and piston seal 141 without elongating the entire length of the pump mechanism 121, thus providing more room for the positional control of the piston seal 141 for closing the ink such inlet 136. As a result, the dimensional tolerances can be lowered for cams and others required for the reciprocation of the pump mechanism 121. The cost can be reduced accordingly. At the same time, with the increased depression area of the piston seal 141, the forces exerted on the piston seal 141 can be dissipated to eliminate any local deformation such as distortion and warping during the reciprocal shifting (motion) of the piston seal 141.

Figure 23:
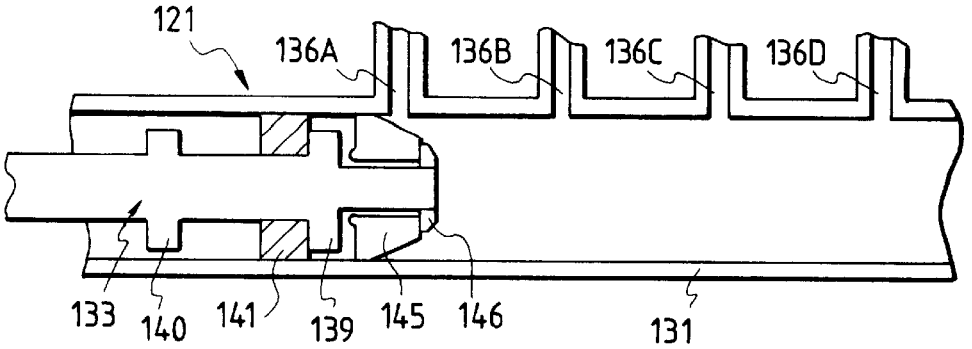
FIG. 23 is a vertically sectional view partially and schematically showing an eighth embodiment of a pump mechanism according to the present invention.

FIG. 23 is a vertically sectional view showing the cylinder 131, piston 145, and others of the pump mechanism 121 according to the eighth embodiment to which the present invention is applied. In FIG. 23, ink suction inlets 136A, 136B, 136C and 136D are provided for the cylinder 131 at plural positions (four for an example represented in FIG. 23) at given intervals in the stroking direction. These ink suction inlets 136 are connected respectively to each different cap 120 (not shown). These plural (four) caps are such that in a case of a recording apparatus provided with plural recording heads 101 using different kinds of ink such as a color recording apparatus, a plurality of caps 120 are used for each of the recording heads 101. Then, the foregoing plural ink suction inlets 136A to 136D are connected to these plural caps 120.

In the embodiment shown in FIG. 23, the suction operation described in conjunction with FIG. 15 to FIG. 20 is executed with a time lag for each of the suction inlets 136. For example, at first, a suction operation is conducted for a first suction inlet 136A in accordance with the sequence shown in FIG. 15 to FIG. 20. After this suction operation is terminated, the piston shaft 133 is shifted to a position where it can operate the same suction operation for a second suction inlet 136B to execute the suction operation in the same manner. The suction operation for the second ink suction inlet 136B is terminated, the piston shaft 133 is shifted to the next position to execute the same suction operation for a third suction inlet 136C. Then, the piston shaft 133 is further shifted to the next position to the same suction operation for a fourth suction inlet 136D. In this way, the suction operations are conducted for each of the ink suction inlets 136. After all the suction operations are completed, the piston shaft will return to the standby state. In this respect, if the suction should begin at an arbitrary ink suction inlet 136, the piston shaft 133 would be shifted to such a position, and it may be possible to execute the suction operation for a desired suction inlet 136 only.

In a recording apparatus using a plurality of recording heads such as a color ink jet recording apparatus, it has hitherto been required to provide a plurality of pump mechanisms (four for the example shown in FIG. 23), but according to the embodiment described in conjunction with FIG. 23, it is possible to perform suction from each of the plural recording heads 101 with only one pump mechanism 121. Therefore, it will suffice only if one pump mechanism 121 is provided for the purpose, thus enabling a significant saving of space in the ejection recovery system. A cost reduction is also attained.

In this respect, in each of the foregoing embodiments, the description has been made exemplifying a serial type ink jet recording apparatus wherein recording means (head cartridge) 101 is mounted on a carriage 104 to conduct its main scanning along a recording material 116, but the present invention is equally applicable to a line-type ink jet recording apparatus using full-line type recording means wherein the discharging ports are formed to cover the entire width of the recording area of a recording material. The same effects are also attainable.

Also, in each of the foregoing embodiments, a case where recording is performed with one recording means 101 is exemplified. However, the present invention is also applicable to a color ink jet recording apparatus provided with a plurality of recording means for performing recording in different colors or to an ink jet recording apparatus for tonal recording using a plurality of recording means for performing recording with ink having a same color but different densities. Thus, the present invention is equally applicable irrespective of the number of recording means (recording heads). The same functional effects are also attainable. Furthermore, the present invention is not only applicable to an ink jet recording apparatus using a cartridge type recording means (head cartridge) 1 having a recording head and an ink tank integrally formed; but also to an ink jet recording apparatus wherein a recording head and ink tank are provided separately and then the structure is arranged to connect them with an ink supply tube or to an ink jet recording apparatus having a structural mode of some other recording head and ink tank. The present invention is equally applicable to any one of them. The same effects are also obtainable.

Now, hereinafter, in conjunction with the accompanying drawings, the description will be made of the cap for a recovery mechanism to achieve the objects of the present invention.

Figure 24:
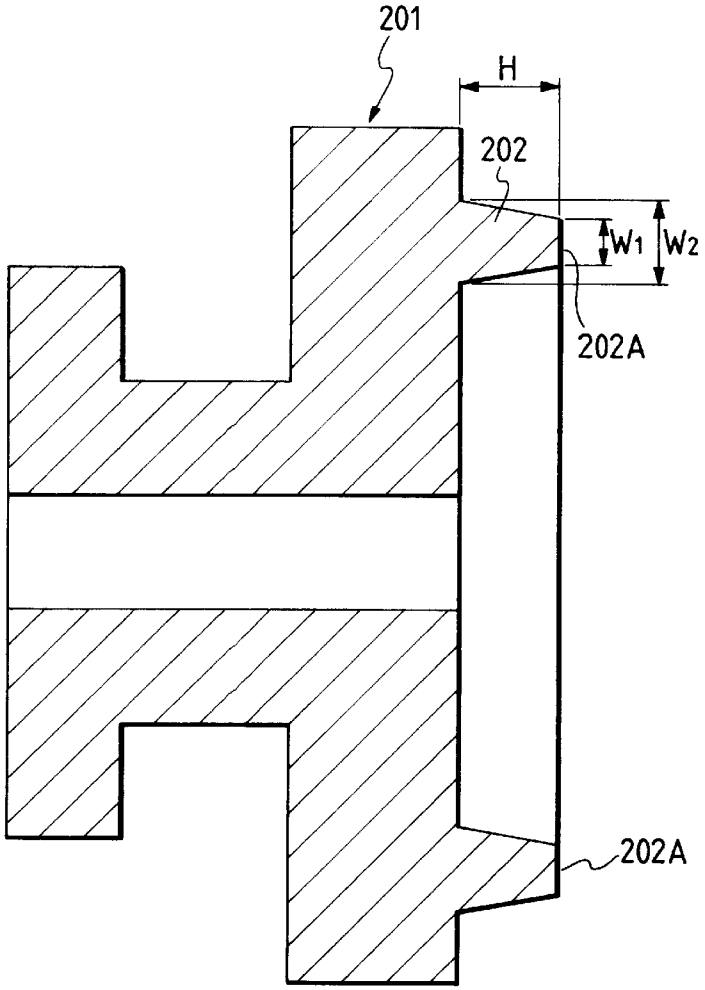
FIG. 24 is a cross-sectional view showing an example of the structure of a conventional capping member.

FIG. 24 is a view showing the structural example of a conventional capping member provided at a position opposite to a recording head of an ink jet recording apparatus and mounted on the ink discharging surface of the recording head when the recording operation is at rest or a recovery operation for the recording head is requested. Here, a reference numeral 201 designates a capping member (main body); 202, a sealing portion arranged on the peripheral surface of the capping member 201 facing the recording head; and 202A, sealing surface formed on the protruded leading face of the sealing portion 202. Further, in this respect, the sealing portion 202 is formed so that its thickness gradually becomes thinner toward the leading end in cross-section as shown in FIG. 24 (for example, in FIG. 24, H=approximately 0.4 mm, $W_1$=0.2 to 0.3 mm, and $W_2$=0.5 to 0.6 mm), and its width is as extremely narrow as approximately 0.2 to 0.3 mm at the sealing surface 202A. To form it so thin as this, the sealing surface 202A can be deformed slightly when it is mounted on the ink discharging surface. Thus, it is made easier for both faces to be closely in contact so as to prevent any admission of dust particles.

Figure 25:
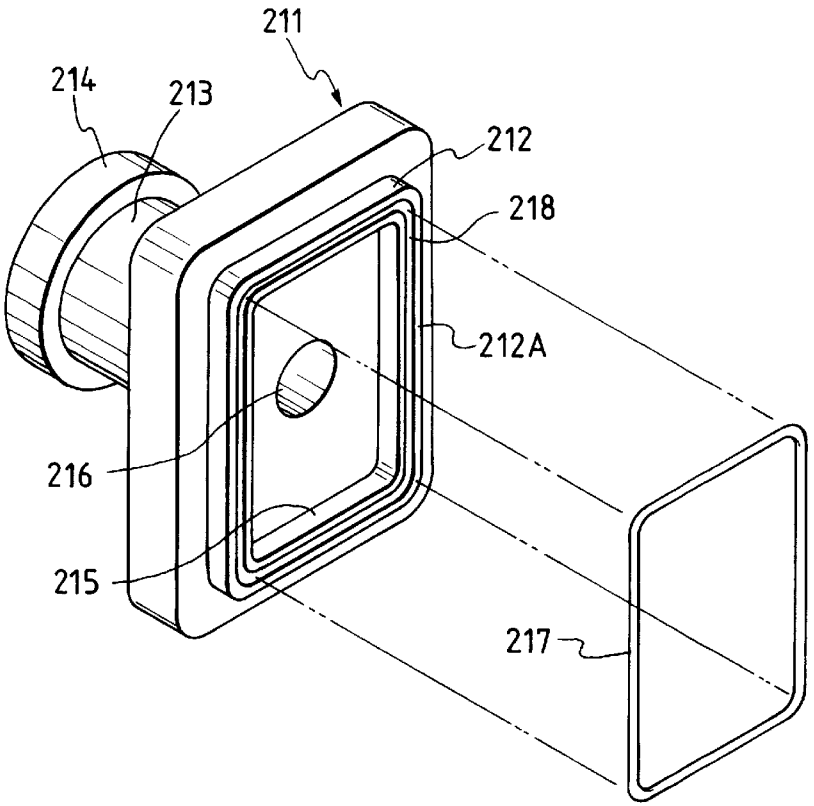
FIG. 25 is an exploded perspective view showing the structure of a ninth embodiment according to the present invention.
Figure 26:
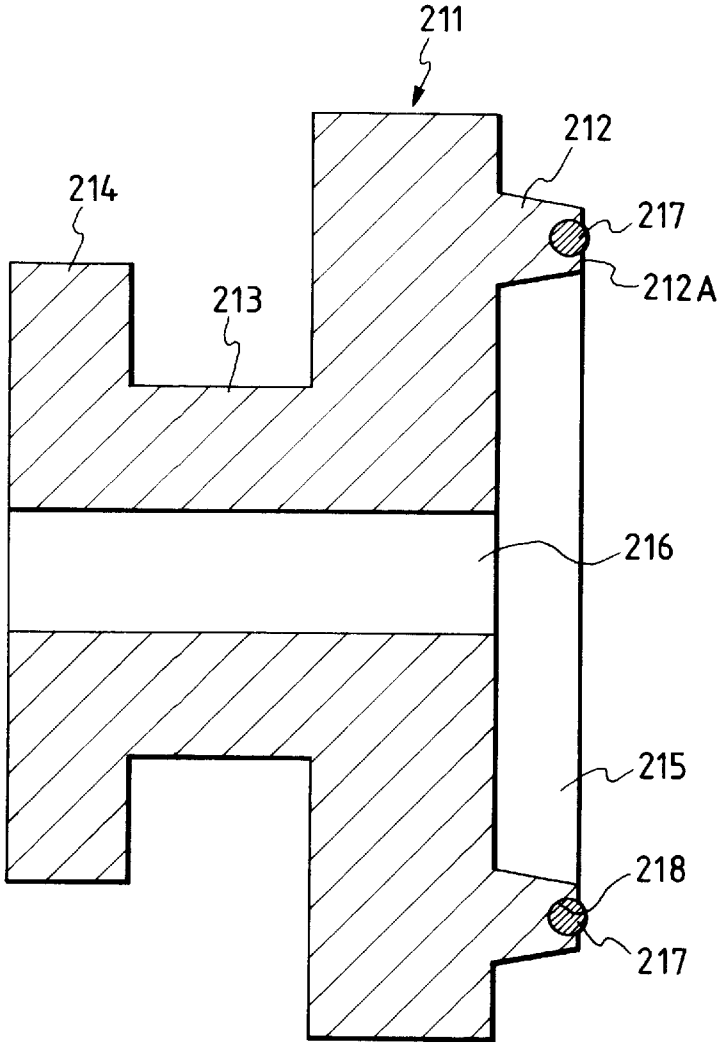
FIG. 26 is a cross-sectional view of the ninth embodiment shown in FIG. 25.

FIG. 25 and FIG. 26 are views showing a ninth embodiment according to the present invention. Here, a reference numeral 211 designates a capping member main body formed by means of an injection molding process with chlorinated butyl or some other resin material having an excellent gas barrier capability and a property that its dissolved harmful component is small, for example; also, 212, a sealing portion formed integrally with the capping member 211; 213, a mounting portion for mounting the body on the cap lever; and 214, a ring portion formed on the mounting portion 213 prevent it from being withdrawn. Also, in the center of the capping member 211, a suction passage 216 is provided for guiding ink to be sucked from its crown fitting mouth 215 by the pump mechanism.

A reference numeral 217 designates a sealing member with a circular cross section formed with silicon rubber or some other resilient resin material which is easy to be formed by an ejection molding and has an excellent restoration capability from compression. In this respect, in producing such a sealing member as the one at 217, it is possible to use an ejection molding wherein a mold which can be separated in front and rear portions can be used as in manufacturing an O-ring, for example. With a molding method of the kind, it is possible to avoid creating the flashes on the surface of the sealing member which is in contact with the ink discharging surface of the recording head. Such flashes will hinder desirable sealing. With this molding method, therefore, the sealing members 217 can be obtained with an overall evenness. There is also almost no possibility of defective formation in producing them.

In this respect, such a sealing member 217 is held in a seal holding groove 218 formed along the sealing face of the sealing portion 212 having substantially a C-letter cross-section as shown in FIG. 26. As a sealing member 217, it is held in a state that part of its circular face is slightly protruded from the sealing surface 212A. Consequently, when the sealing surface 212A side is compressed to be in contact with the ink discharging surface of the recording head, most of the protruded portion of the sealing member 217 are deformed to be retracted to the position close to the sealing surface 212A. As it is held in such a state, ink solvent and others are vaporized and are not permeated through the seal portion to the outside.

Figure 27:
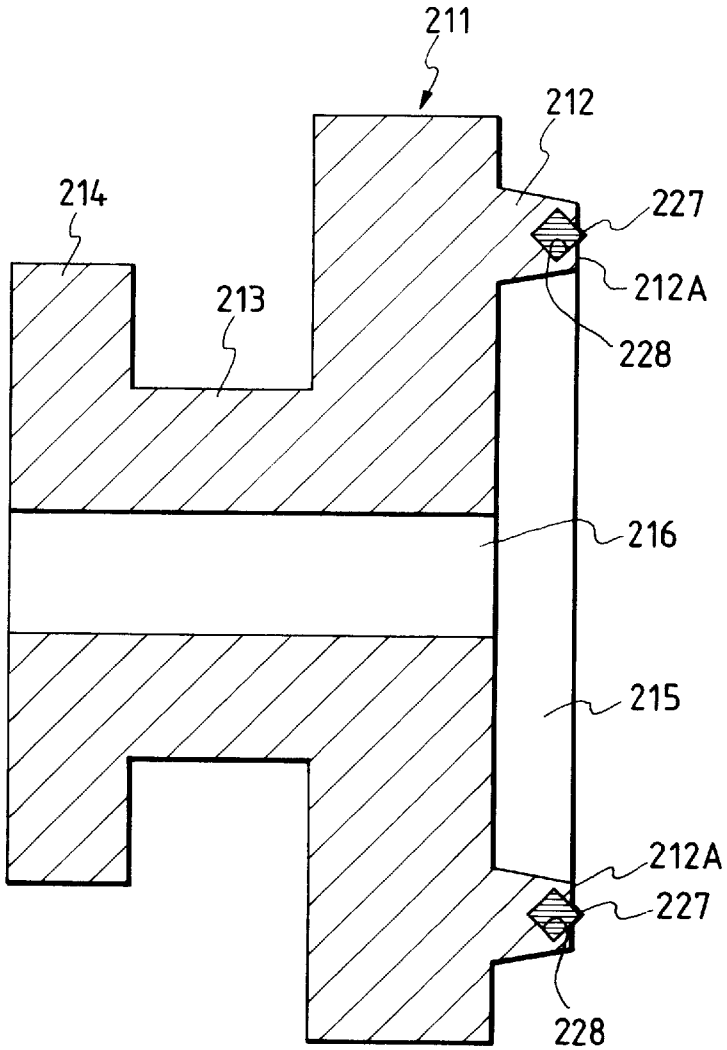
FIG. 27 is a cross-section view of a tenth embodiment according to the present invention.

FIG. 27 is a view showing a tenth embodiment according to the present invention. The present embodiment uses the same material as in the ninth embodiment to make the sealing member 227 to be the one having a square cross-section as well as square columns which are protruded in the direction of the annular sealing face. In forming such a sealing member 227, it is still possible to apply the coupling mold as in the case of the ninth embodiment, but it should be good enough to form a seal member having a square cross-section by means of a continuous compression molding and then cut it in a given length. Then, the sealing member thus cut is set in a square seal holding groove 228 without creating any gap in the connecting part. The feature of the present embodiment is that it is easy to form the sealing member 227, which will contribute to reducing cost. Also, since the portion of the sealing member 227 which is in contact with the ink discharging surface is of an edge type, it is also easy to deform such a portion for the closer contact between them, hence making it possible to minimize the compression force to be exerted when the capping member 211 is depressed toward the recording head.

Figure 28:
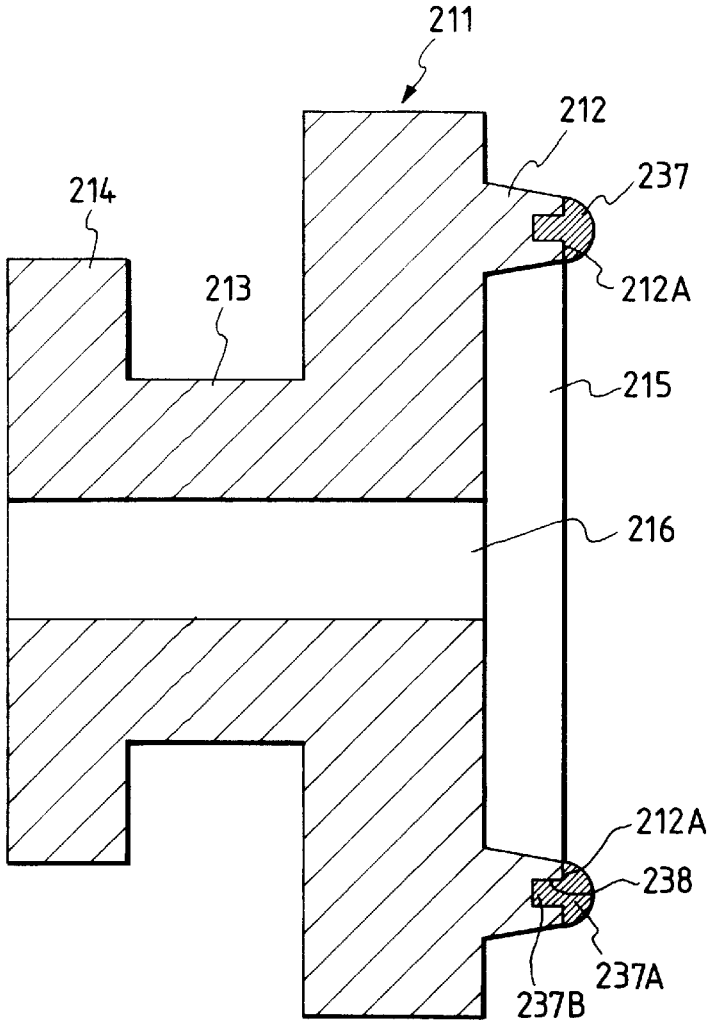
FIG. 28 is a cross-section view of an eleventh embodiment according to the present invention.

FIG. 28 is a view showing an eleventh embodiment according to the present invention. The present embodiment uses the same material as in the ninth embodiment and the tenth embodiment to form the sealing member 237 in an annular type having a rivet shape cross-section. The portion 237A corresponding to its round head is arranged to be in contact with the ink discharging surface. In this respect, the staged annular portion 237B is fitted into the annular seal holding groove 238 formed on the sealing surface 212A. Furthermore, while a semi-circular cross-section is given to the portion to be in contact with the ink discharging surface in the present embodiment, any configuration will do if only it can easily be deformed when it is in contact therewith.

Figure 29:
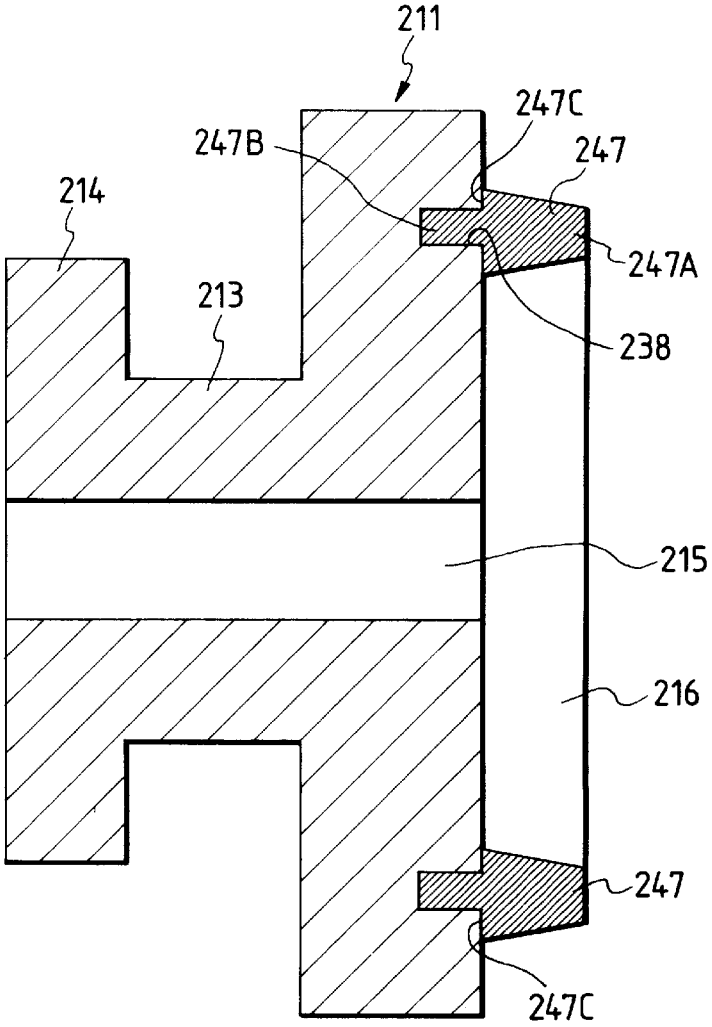
FIG. 29 is a cross-section view of a twelfth embodiment according to the present invention.

FIG. 29 is a view showing a twelfth embodiment according to the present invention. The present embodiment also uses the same material as in the ninth embodiment to the eleventh embodiment to make the sealing member 247. Here, however, the sealing member 247 is formed so that its cross-section of the portion to be in contact with the ink discharging surface side is configured to be substantially of a trapezoidal type and at the same time, a stage is formed between the annular portion 247B to be mounted in the annular groove 238 on the capping member 211 side and the seal portion 247A. This member is held in such a state that this staged portion 247C is in contact with the front face of the capping member 211. In this respect, the cross-sectional configuration of the seal portion 247A is not necessarily confined to the trapezoid as shown in FIG. 29 as a matter of course.

A capping member 211 according to each of the foregoing embodiments is such that the member itself is not integrally formed with the seal portion to hold the sealing member but is separately formed, thus making the formation of the capping member 211 easier. Accordingly, there is a significant advantage that it is possible to reduce the number of defective products due to insufficient injection to the formation part for the seal portion at the time of molding.

In this respect, the present invention is effectively applicable to ink jet recording methods, particularly to an ink jet recording head and apparatus having a method, among them, wherein means (electrothermal transducers, laser beam, or the like) is provided for generating thermal energy as energy to be utilized for ink ejection and then with the foregoing thermal energy, the state of ink can be changed. According to such a method as this, it is possible to attain a highly precise recording with a high density.

Regarding the typical structure and operational principle of such a method, it is preferable to adopt those which can be implemented using the fundamental principle disclosed in the specifications of U.S. Pat. Nos. 4,723,129 and 4,740,796. This method is applicable to a so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed for a liquid (ink) retaining sheet or liquid passage whereby to cause the electrothermal transducer to generate thermal energy to produce film boiling on the thermoactive portion of the recording head, thus effectively leading to the resultant formation of a bubble in the recording liquid (ink) one to one for each of the driving signals. By the development and contraction of the bubble, the liquid (ink) is ejected through a discharging port to produce at least one droplet. The driving signal is preferably in the form of a pulse because the development and contraction of the bubble can be exerted instantaneously, and therefore, the liquid (ink) is ejected with quick response.

The driving signal in the form of the pulse is preferably such as disclosed in the specifications of U.S. Pat. Nos.

4,463,359 and 4,345,262. In addition, the temperature increasing rate of the thermoactive surface is preferably such as disclosed in the specification of U.S. Pat. No. 4,313,124 for an excellent recording in a better condition.

The structure of the recording head may be as disclosed in each of the above-mentioned specifications (linear type liquid passage or right angle liquid passage). Besides, the structure such as disclosed in the specifications of U.S. Pat. Nos. 4,558,333 and 4,459,600 wherein the thermal activation portions are arranged in a curbed area is also included in the present invention. In addition, the present invention is applicable to the structure disclosed in Japanese Patent Laid-Open Application No. 59-123670 wherein a common slit is used as the discharging port for plural electrothermal transducers, and to the structure disclosed in Japanese Patent Laid-Open Application No. 59-138461 wherein an opening for absorbing pressure waves of the thermal energy is formed corresponding to the ejecting portion. In other words, according to the present invention, it becomes possible to operate recording assuredly irrespective of the modes of the recording head.

Further, the present invention is effectively applicable to a full-line type recording head having a length corresponding to the maximum width of a recording medium that the recording apparatus can use for recording. For such a recording head, it may be possible to employ a structure to fulfill such length either by the combination of a plurality of recording heads or by a single recording head integrally fabricated.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

As regards the kind and number of the recording heads mountable on the carriage, it may be a single head corresponding to a single color ink, or may be plural heads corresponding to a plurality of ink materials having different recording color or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, as modes of the foregoing ink jet recording apparatus, a copying apparatus combined with a reader and the like or a facsimile apparatus having transmission and reception functions or the like may be employed in addition to those used as an image output terminal of an information processing apparatus such as a computer.

As described above, according to the ninth embodiment to the eleventh embodiment, it is arranged that the sealing member formed with a resilient material, which is separately molded, is mounted on the seal portion of the foregoing capping member. Therefore, it becomes possible to form independent of the capping member the sealing member which is easily damaged at the time of manufacturing and tends to create defective products with a material having excellent properties in restoration from compression and others. Then, each of them, made of material optimally suitable for its function respectively, is assembled into an integrated body. Hence, it becomes possible to provide a capping member in order to assure a stabilized sealing condition as well as a recovery operation.

In this respect, the structures of the first embodiment to the fourth embodiment, the fifth embodiment to the eighth embodiment, and the ninth embodiment to the twelfth embodiment set forth above are capable of demonstrating its effects either by each of them individually or by a structure constructed by an arbitrary combination thereof. The most preferable recovery mechanism is such as a combination of the respective structures.

As described above, according to the present invention, it is possible to obtain a recovery mechanism capable of providing an ink jet recording head with a stable-ink ejection function and an ink jet recording apparatus using the aforesaid recovery mechanism as well.

What is claimed is:

1. An ink jet recording apparatus for performing recording on a recording medium, said apparatus comprising:

a carriage having a mounting portion for mounting an ink jet recording head for performing recording on the recording medium by ejecting ink from an ink discharging port, said carriage for carrying the ink jet recording head in given directions;

means for moving said carriage in the given directions;

a recovery mechanism for preventing disabled ejection of the ink jet recording head, wherein said means for moving said carriage includes means for moving the ink discharging port to a position facing said recovery mechanism and said recovery mechanism prevents disabled ejection of the ink jet recording head when the ink discharging port is at the position facing said recovery mechanism;

a common driving power source having an output shaft;

a pinion slidably mounted on the output shaft; and means for moving said pinion between a first position on the output shaft and a second position on the output shaft, said Pinion connected to said recovery mechanism at the first position and connected to said means for moving said carriage at the second position.

2. An ink jet recording apparatus according to claim 1, wherein said pinion is biased to one of the first position and the second position by a spring member.

3. An ink jet recording apparatus according to claim 1, wherein said pinion is biased to one of the first position and the second position by a magnet.

4. An ink jet recording apparatus according to claim 1, further comprising the ink jet recording head mounted on said mounting portion, wherein said ink jet recording head comprises means for energizing electrothermal transducers in accordance with recording signals to utilize film boiling occurring in ink due to the thermal energy generated by said electrothermal transducers to eject ink for recording.

5. An ink jet recording apparatus according to claim 1, further comprising the ink jet recording head mounted on said mounting portion, wherein said ink jet recording head comprises a reservoir for storing ink for recording.

6. A recovery mechanism for an ink jet recording apparatus provided with a carriage having a mounting portion for an ink jet recording head for performing recording on a recording medium by ejecting ink from an ink discharging port, the carriage being arranged for carrying the ink jet recording head in given directions with a carriage moving device, said mechanism comprising:

recovery means for effecting recovery of the ink jet recording head, wherein said recovery means effects the recovery when the carriage moving device moves the carriage so as to position the ink discharging port facing the recovery means;

a common driving power source having an output shaft;

a pinion slidably mounted on the output shaft; and means for moving said pinion between a first position on the output shaft and a second position on the output shaft, said Pinion connected to said recovery means at the first position and connected to said means for moving said carriage at the second position.

7. A recovery mechanism according to claim 6, further comprising the ink let recording head, wherein said ink jet recording head comprises means for energizing electrothermal transducers in accordance with recording signals to utilize film boiling occurring in ink due to the thermal energy generated by said electrothermal transducers to eject ink for recording.

8. A recovery mechanism according to claim 6, further comprising the ink let recording head, wherein said ink jet recording head comprises a reservoir for storing ink for recording.

9. An apparatus for performing recovery of an ink jet recording device according to claim 6, the ink jet recording device including an ink jet recording head, in which the discharge port is provided, for performing recording on a recording medium by ejecting ink from the discharge port, and including a mounting portion for mounting the ink let recording head thereon, the apparatus further comprising:

a recovery mechanism comprising said cap, said suction means and means for reciprocating said piston shaft, said piston, and said sealing member, wherein said mounting portion positions the recording head adjacent said recovery mechanism to prevent disabled ejection of the ink jet recording head and said sealing member is shifted by said reciprocating means in order to close an ink suction inlet of said cylinder, wherein said sealing member is formed of a solid, non-porous material and closes said ink suction inlet in accordance with reciprocating movement of said piston.

10. An ink jet recording apparatus according to claim 9, further comprising the ink jet recording head mounted on said mounting portion, wherein said ink jet recording head comprises means for energizing electrothermal transducers in accordance with recording signals to utilize film boiling occurring in ink due to the thermal energy generated by said electrothermal transducers to eject ink for recording.

11. An ink jet recording apparatus according to claim 9, further comprising the ink jet recording head mounted on said mounting portion, wherein said ink jet recording head comprises a reservoir for storing ink for recording.

12. An apparatus for performing recovery of an ink jet recording device, the apparatus comprising:

a cap for covering a discharge port for discharging ink; and suction means for generating a pressure change in said cap to suck ink from the discharge port when said cap covers the discharge port, wherein said suction means comprises:

a cylinder having an inner surface, a piston shaft located in said cylinder for reciprocal movement therein, a piston fitted to said piston shaft for movement in an axial direction together with and relative to said piston shaft, said piston contacting the inner surface of said cylinder, and a sealing member fitted to said piston shaft and moving in the axial direction together with and relative to said piston shaft, wherein said sealing member includes a sliding portion arranged for sliding contact with the inner surface of said cylinder and portions of said sealing member other than said sliding portion are formed with a material more rigid than a material forming said sliding portion, and wherein a space for generating the pressure change in said cap is defined by said cylinder, said piston and said sealing member.

13. An apparatus according to claim 12, wherein said sealing member is conically shaped.

14. An apparatus for performing recovery of an ink jet recording device according to claim 12, the ink jet recording device including an ink jet recording head, in which the discharge port is provided, for performing recording on a recording medium by ejecting ink from the discharge port, and including a mounting portion for mounting the ink let recording head thereon and for positioning the recording head adjacent said cap, wherein said cap covers the ink jet recording head when the mounting portion is positioned adjacent said cap for preventing ink evaporation from the ink jet recording head and disabled ink ejection, and wherein said cap comprises a mounted cap sealing member made of an elastic material.

15. An apparatus according to claim 14, wherein said mounted cap sealing member comprises a molded, resilient resin material.

16. An apparatus according to claim 14, further comprising the ink jet recording head mounted on said mounting portion to form an ink jet recording apparatus, wherein said ink jet recording head comprises means for energizing electrothermal transducers in accordance with recording signals to utilize film boiling occurring in ink due to the thermal energy generated by said electrothermal transducers to eject ink for recording.

17. An apparatus according to claim 14, further comprising the ink jet recording head mounted on said mounting portion to form an ink jet recording apparatus, wherein said ink jet recording head comprises a reservoir for storing ink for recording.

18. An ink jet recording apparatus comprising:

a plurality of caps, each of said plurality of caps for covering a respective one of a plurality of discharge ports for discharging ink;

suction means for generating a pressure change in said caps to suck ink from said discharge ports when each of said plurality of caps covers the respective one of said discharge ports, wherein said suction means comprises a cylinder having an inner surface, a piston mounted for movement in said cylinder and being in contact with the inner surface of said cylinder, wherein said cylinder is provided with a plurality of suction ports, each of said plurality of suction ports for generating the pressure change in one of said plurality of caps, said ports being consecutively disposed in a moving direction of said piston in said cylinder, a sealing member which reciprocates in said cylinder, and means for reciprocating said piston and said sealing member, wherein said sealing member is shifted by said reciprocating means in order to close an ink suction inlet of said cylinder, wherein said sealing member is formed of a solid, non-porous material and closes said ink suction inlet in accordance with reciprocating movement of said piston;

a mounting portion for mounting a plurality of ink jet recording heads, in which each respective discharge port is provided, for performing recording on a recording medium by ejecting ink from the respective discharge port; and a recovery mechanism for preventing disabled ejection of the ink jet recording heads when said mounting portion positions said recording heads adjacent said caps, said recovery mechanism comprising said caps and said suction means.

19. An ink jet recording apparatus according to claim 18, further comprising the plurality of ink jet recording heads mounted on said mounting portion, wherein each of said ink jet recording heads comprises means for energizing electrothermal transducers in accordance with recording signals to utilize film boiling occurring in ink due to the thermal energy generated by said electrothermal transducers to eject ink for recording.

20. An ink jet recording apparatus according to claim 18, further comprising the plurality of ink jet recording heads mounted on said mounting portion, wherein each of said ink jet recording heads comprises a reservoir for storing ink for recording.

21. An ink jet recording apparatus according to claim 18, wherein said sealing member comprises a sliding portion for sliding contact with said cylinder and portions of said sealing member other than the sliding portion are formed with a material more rigid than a material forming said sliding portion.

22. An ink jet recording apparatus according to claim 18, wherein said sealing member is conically shaped.

23. An ink jet recording apparatus according to claim 18, wherein said caps cover the ink jet recording heads when the mounting portion is positioned adjacent said caps for preventing ink evaporation from the ink jet recording heads and disabled ink ejection, wherein each of said caps comprises a mounted cap sealing member made of an elastic material.

24. An ink jet recording apparatus according to claim 23, wherein said mounted cap sealing member comprises a molded, resilient resin material.

25. An ink jet recording apparatus according to claim 23, further comprising the plurality of ink jet recording heads, wherein each of said ink jet recording heads comprises means for energizing electrothermal transducers in accordance with recording signals to utilize film boiling occurring in ink due to the thermal energy generated by said electrothermal transducers to eject ink for recording.

26. An ink jet recording apparatus according to claim 23, further comprising the plurality of ink jet recording heads, wherein each of said ink jet recording heads comprises a reservoir for storing ink for recording.

27. An ink jet recording apparatus for performing recording on a recording medium, said apparatus comprising:

a carriage having a mounting portion for mounting an ink jet recording head for performing recording on the recording medium by ejecting ink from an ink discharging port, said carriage for carrying the ink jet recording head in given directions;

means for moving said carriage in the given directions;

a recovery mechanism for preventing disabled ejection of the ink jet recording head when said carriage moves the ink discharging port to a position adjacent said recovery mechanism;

a common driving power source having an output shaft;

a pinion slidably mounted on the output shaft; and means for moving said pinion between a first position on the output shaft and a second position on the output shaft, said pinion connected to said recovery mechanism at the first position and connected to said means for moving said carriage at the second position.

28. A recovery mechanism for an ink jet recording apparatus provided with a carriage having a mounting portion for an ink jet recording head for performing recording on a recording medium by ejecting ink from an ink discharging port, the carriage being arranged for carrying the ink jet recording head in given directions with a carriage moving device, said mechanism comprising:

recovery means for effecting recovery of the ink jet recording head;

a common driving power source having an output shaft;

a pinion slidably mounted on the output shaft; and means for moving said pinion between a first position on the output shaft and a second position on the output shaft, said pinion connected to said recovery mechanism at the first position and connected to said means for moving said carriage at the second position.

29. An apparatus for performing recovery of an ink jet recording device, the apparatus having a cap for covering a discharge port for discharging ink and suction means for generating in said cap a pressure change for sucking ink from said discharge port when said cap covers said discharge port, said suction means comprising:

a cylinder having therein a suction port;

a piston shaft reciprocally movable in said cylinder;

a piston fitted to said piston shaft for movement in an axial direction of said piston shaft, said piston contacting an inner surface of said cylinder; and a sealing member slidably fitted to said piston shaft for movement independent of the movement of said piston in an axial direction of said piston shaft, said sealing member contacting an inner surface of said cylinder, and a space for generating the pressure change in said cap being defined by said cylinder said piston and said sealing member, wherein the pressure change is generated by movement of said piston in a direction away from said sealing member when said sealing member is not in a position for closing said suction port, and waste ink in said space is exhausted by movement of said piston in a direction toward said sealing member when said sealing member is in a position for closing said suction port.

30. An apparatus according to claim 29, wherein a plurality of said suction port is arranged along the axial direction.

* * * * *

UNITED STATES PATENT AND TRADEMARK OFFICE

CERTIFICATE OF CORRECTION

PATENT NO. : 5,883,645

DATED : March 16, 1999

INVENTORS : MASAHARU IKADO et al.

It is certified that error appears in the above-identified patent and that said Letters Patent is hereby corrected as shown below:

On The Title page:

Item [56]

References Cited

U.S. PATENT DOCUMENTS

"Airano" should read --Hirano--.

OTHER PUBLICATIONS

"Chmical" should read --Chemical--.

ABSTRACT

Line 1, "Ink" should read --An ink--.

COLUMN 2

Line 9, "deformed" should read --be formed--.

UNITED STATES PATENT AND TRADEMARK OFFICE

CERTIFICATE OF CORRECTION

PATENT NO. : 5,883,645

DATED : March 16, 1999

INVENTORS : MASAHARU IKADO et al.

It is certified that error appears in the above-identified patent and that said Letters Patent is hereby corrected as shown below:

COLUMN 3

Line 9, after "power" insert --source--.

COLUMN 6

Line 47, "be flown" should read --flow--.

COLUMN 8

Line 38, "which" should read --which is--.

COLUMN 17

Line 21, "such" should read --suction--.

UNITED STATES PATENT AND TRADEMARK OFFICE

CERTIFICATE OF CORRECTION

PATENT NO. : 5,883,645

DATED : March 16, 1999

INVENTORS : MASAHARU IKADO et al.

It is certified that error appears in the above-identified patent and that said Letters Patent is hereby corrected as shown below:

COLUMN 21

Line 40, "color" should read --colors--.

COLUMN 22

Line 11, "stable-ink" should read --stable ink--.

Line 35, "Pinion" should read --pinion--.

COLUMN 23

Line 5, "Pinion" should read --pinion--.

Line 9, "let" should read --jet--.

Line 20, "claim 6," should read --claim 12,--.

Line 24, "let" should read --jet--.

Signed and Sealed this

Thirtieth Day of November, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,883,645

DATED : March 16, 1999

INVENTOR(S) : MASAHARU IKADO et al.

It is certified that error appears in the above-identified patent and that said Letters Patent is hereby corrected as shown below:

COLUMN 12

Line 20, "portion" should read --portions--.

Signed and Sealed this

Sixteenth Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,883,645

DATED : March 16, 1999

INVENTOR(S) : Ikado et al.

It is certified that error appears in the above-identified patent and that said Letters Patent is hereby corrected as shown below:

Title page, item [73]
ABSTRACT:

Lines 14 and 15, "pistion" should read --piston--.

Signed and Sealed this

Thirtieth Day of May, 2000

*Attest:*

Q. TODD DICKINSON

*Attesting Officer*

*Director of Patents and Trademarks*